US012747048B2

(12) United States Patent
Tomlin

(10) Patent No.: US 12,747,048 B2
(45) Date of Patent: Sep. 29, 2026

(54) TAMPER-INDICATING DEVICE INSTALLATION TOOLS AND RELATED TAMPER-INDICATING DEVICES, ASSEMBLIES, SYSTEMS, AND METHODS

(71) Applicant: BATTELLE SAVANNAH RIVER ALLIANCE, LLC, Aiken, SC (US)

(72) Inventor: Michael C. Tomlin, Augusta, GA (US)

(73) Assignee: Battelle Savannah River Alliance, LLC, Aiken, SC (US)

( * ) Notice: Subject to any disclaimer, the term of this patent is extended or adjusted under 35 U.S.C. 154(b) by 0 days.

(21) Appl. No.: 19/056,959

(22) Filed: Feb. 19, 2025

(65) Prior Publication Data

US 2025/0263184 A1 Aug. 21, 2025

Related U.S. Application Data

(60) Provisional application No. 63/556,109, filed on Feb. 21, 2024.

(51) Int. Cl.
*B65B 7/00* (2006.01)
*B65B 7/28* (2006.01)
*B65B 51/04* (2006.01)

(52) U.S. Cl.
CPC ..... *B65B 7/2842* (2013.01); *B65B 51/04* (2013.01)

(58) Field of Classification Search
CPC ..... B21J 15/041; B21J 15/34; B21J 15/383; B65D 2211/00; B65D 2401/00; B65D 55/14; B65D 90/008; B65D 90/22
(Continued)

(56) References Cited

U.S. PATENT DOCUMENTS 2,080,685 A 5/1937 Ashe
4,008,585 A * 2/1977 Lundberg ..... G01R 11/04 70/164
(Continued)

FOREIGN PATENT DOCUMENTS

CN 201351108 Y 11/2009
CN 103145074 A 6/2013
(Continued)

OTHER PUBLICATIONS

Dennison et al., "Application of Glove Box Robotics to Hazardous Waste Management", American Nuclear Society 6th Topical Meeting on Robotics and Remote Systems, Feb. 5-10, 1995 in Monterey, California, 10 pages.
(Continued)

*Primary Examiner* — Jacob A Smith
(74) *Attorney, Agent, or Firm* — Dority & Manning, P.A.

(57) ABSTRACT

In one aspect, a method for installing tamper-indicating assemblies relative to drum enclosure assemblies includes supporting, with an installation tool, a tamper-indicating assembly relative to a drum enclosure assembly such that at least a portion of a closure bolt of the drum enclosure assembly and first and second flanged ends of a lid ring of the drum enclosure assembly are received within a cavity of a tamper-indicating device (TID) of the tamper-indicating assembly. The method also includes inserting, with the installation tool, a pin of the tamper-indicating assembly through a bore of the TID and across a cavity of the TID and deforming, with the installation tool, a portion of the pin relative to the TID to secure the pin within the bore of the TID.

20 Claims, 26 Drawing Sheets

(58) Field of Classification Search
USPC ..... 227/55, 10, 135, 147, 156, 2
See application file for complete search history.

(56) References Cited

U.S. PATENT DOCUMENTS

| | | | | |
|---|---|---|---|---|
| 4,652,204 | A | 3/1987 | Arnett | |
| 4,676,712 | A | 6/1987 | Hayward et al. | |
| 4,709,841 | A * | 12/1987 | Wollar | B21J 15/041 29/524.1 |
| 4,936,743 | A | 6/1990 | Stoss | |
| 4,957,317 | A * | 9/1990 | Jakubas | F16B 41/005 411/910 |
| 5,104,024 | A * | 4/1992 | Brewer | B21J 15/34 901/41 |
| 6,151,862 | A | 11/2000 | Griesau | |
| 7,038,585 | B2 | 5/2006 | Hall et al. | |
| 7,740,292 | B1 * | 6/2010 | Fattori | G09F 3/0317 292/307 R |
| 10,577,156 | B2 | 3/2020 | Dagnelie et al. | |
| 10,679,523 | B2 | 6/2020 | Weeks et al. | |
| 11,315,696 | B2 | 4/2022 | Littmann | |
| 2023/0147819 | A1 | 5/2023 | Dalmaso et al. | |

FOREIGN PATENT DOCUMENTS

| | | | |
|---|---|---|---|
| CN | 104084948 | B | 10/2014 |
| CN | 108862143 | A | 11/2018 |
| KR | 860002062 | B1 | 11/1986 |
| KR | 100309396 | B1 | 9/2001 |

OTHER PUBLICATIONS

Koenig, Richard, "K-Area Six-Year Automation Implementation Plan", Proceedings of the INMM & ESARDA Joint Virtual Annual Meeting, 2021, 10 pages.

* cited by examiner

TAMPER-INDICATING DEVICE INSTALLATION TOOLS AND RELATED TAMPER-INDICATING DEVICES, ASSEMBLIES, SYSTEMS, AND METHODS

CROSS-REFERENCE TO RELATED APPLICATIONS

The present application is based upon and claims the right of priority to U.S. Provisional Patent Application No. 63/556,109, filed Feb. 21, 2024, the disclosure of which is hereby incorporated by reference herein in its entirety for all purposes.

FEDERAL RESEARCH STATEMENT

This invention was made with government support under Contract No. 89303321CEM000080 awarded by the U.S. Department of Energy. The government has certain rights in the invention.

FIELD

The present subject matter relates generally to tamper-indicating device (TID) installation tools, as well as associated tamper-indicating devices (TIDs) and related assemblies, systems and methods, for use with a radioactive material drum enclosure. In particular, the present subject matter relates to automated and manual TID installation tools/methods/systems/assemblies, such as by through automated robotic application and/or manual application.

BACKGROUND

Containers and associated systems used to store and ship radioactive materials must be designed and demonstrated to safely contain the radioactive materials and limit personnel exposure, both under normal conditions and in a variety of accident scenarios. For example, the containers and associated systems may be subjected to a variety of tests demonstrating the ability to withstand normal conditions of transport, e.g., water spray test, free drop test, penetration test, compression test, or others, without the loss of any radioactive contents.

Generally, these engineered containers are in the form of cylindrically shaped drum enclosures that are used to confine the radioactive material for the purposes of transportation and storage. These engineered containers are typically referred to as "packagings" and must be secured in a way that provides adequate confinement of the radioactive material. Typically, the ends of the drums are closed utilizing standard bolted drum closure rings, welded fittings, and/or bolts to provide an adequate level of integrity for the package to meet safety and testing regulations required to ship radioactive material.

Once a drum enclosure containing radioactive material is closed and sealed, it is important that the drum enclosure is not opened thereafter by any unauthorized personnel (e.g., the drum enclosure should only be opened by the intended recipient). Additionally, the intended recipient should be made aware if the drum enclosure has been opened or tampered with prior to receipt in order to take appropriate safety precautions.

In this regard, tamper-indicating devices (TIDs) have been developed for indicating whether or not the drum enclosure has been opened and/or tampered with. For instance, US2023/0147819 to Dalmaso et al. (the contents of which are hereby incorporated by reference herein in their entirety for all purposes) discloses a TID having features that facilitate the robotic application of the TID onto a drum disclosure, which allows for application or installation of the TID without requiring human contact or exposure to the drum enclosure. While this TID provides numerous advantages, further improvements and/or refinements to TIDs, themselves, and/or the installation tools/methods used to install/apply such TIDs relative to a drum enclosure would be welcomed in the art.

BRIEF SUMMARY

Aspects and advantages of the present subject matter will be set forth in part in the following description, or may be obvious from the description, or may be learned through practice of the present subject matter.

In one aspect, the present subject matter is directed to a tamper-indicating device (TID) installation tool in accordance with one or more of the embodiments described herein.

In another aspect, the present subject matter is directed to a system for installing tamper-indicating assemblies relative to drum enclosure assemblies in accordance with one or more embodiments described herein.

In several embodiments, the system includes a drum enclosure assembly including a lid ring extending from a first flanged end to a second flanged end. The drum enclosure assembly further includes a closure bolt extending through the first and second flanged ends. The system also includes a tamper-indicating device (TID) defining a cavity configured to receive at least a portion of the closure bolt and the first and second flanged ends of the lid ring. The TID defines a bore relative to the cavity. The system further includes a pin configured to extend through the bore of the TID and across the cavity of the TID, with the pin including a pin body extending from a body end to a head end. Additionally, the system includes an installation tool for installing and securing the pin relative to the TID. The installation tool includes a support assembly configured to support the TID and a pin deformation assembly having first and second pin actuators. The first pin actuator is configured to push the pin through the bore of the TID, and the second pin actuator is configured to deform the head end of the pin relative to the TID.

In a further aspect, the present subject matter is directed to a method for installing tamper-indicating assemblies relative to drum enclosure assemblies in accordance with one or more of the embodiments described herein.

In several embodiments, the method includes supporting, with an installation tool, a tamper-indicating assembly relative to a drum enclosure assembly such that at least a portion of a closure bolt of the drum enclosure assembly and first and second flanged ends of a lid ring of the drum enclosure assembly are received within a cavity of a tamper-indicating device (TID) of the tamper-indicating assembly. The method also includes inserting, with the installation tool, a pin of the tamper-indicating assembly through a bore of the TID and across a cavity of the TID and deforming, with the installation tool, a portion of the pin relative to the TID to secure the pin within the bore of the TID.

In yet another aspect, the present subject matter is directed to a tamper-indicating device (TID) in accordance with one or more of the embodiments described herein.

These and other features, aspects, and advantages of the present subject matter will become better understood with reference to the following Detailed Description and appended claims. The accompanying drawings, which are incorporated in and constitute a part of this specification, illustrate embodiments of the present subject matter and, together with the description, serve to explain the principles of the present subject matter.

This Brief Description is provided to introduce a selection of concepts in a simplified form that are further described below in the Detailed Description. This Brief Description is not intended to identify key features or essential features of the claimed subject matter, nor is it intended as an aid in determining the scope of the claimed subject matter.

BRIEF DESCRIPTION OF THE DRAWINGS

A full and enabling disclosure of the present subject matter, including the best mode thereof, directed to one of ordinary skill in the art, is set forth in the specification, which makes reference to the appended figures, in which.

DETAILED DESCRIPTION

Figure 1:
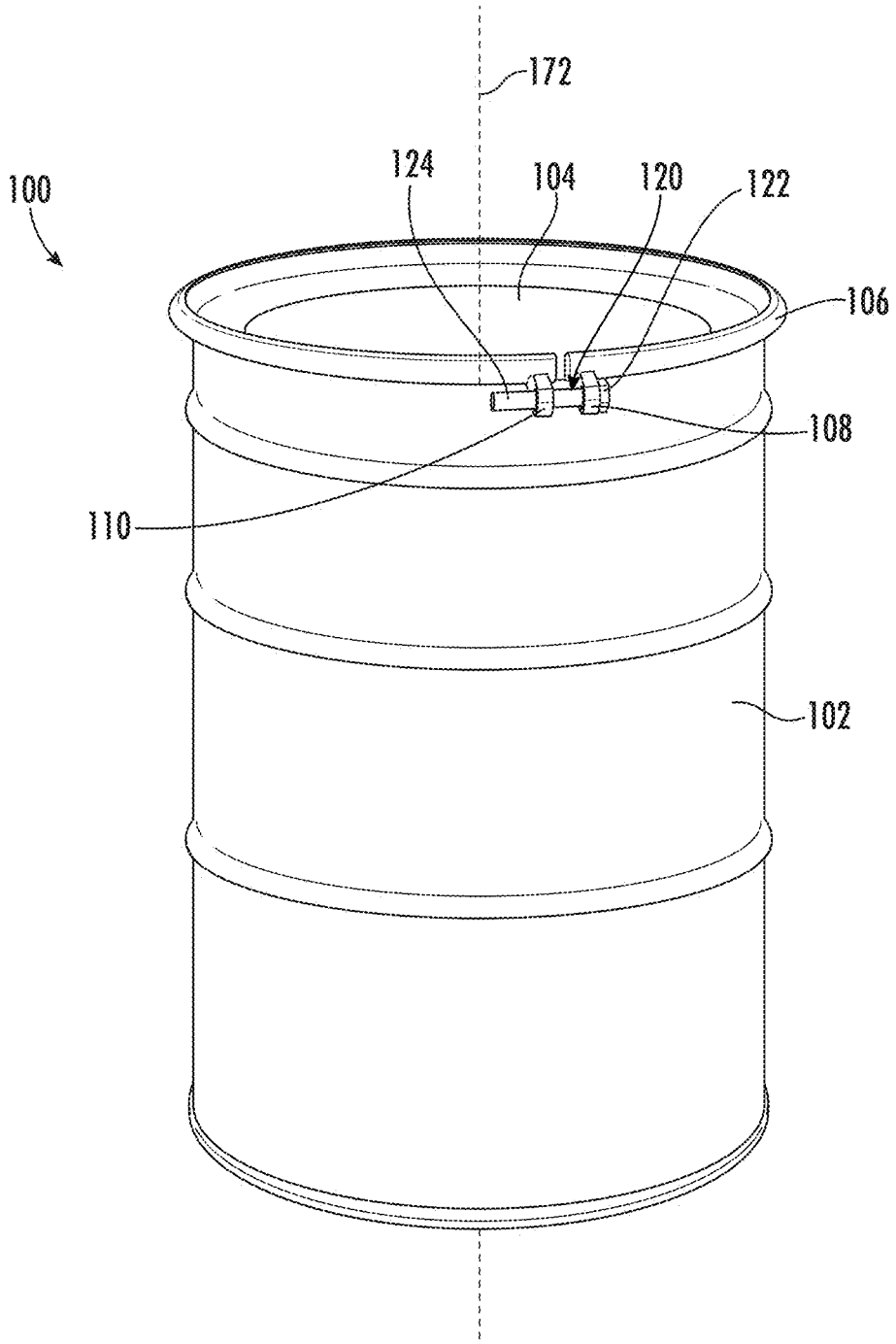
FIG. 1 illustrates a perspective view of one embodiment of a drum enclosure assembly in accordance with aspects of the present subject matter.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield still a further embodiment. Thus, it is intended that the present invention covers such modifications and variations as come within the scope of the appended claims and their equivalents.

In general, the present subject matter is directed to tamper-indicating device (TID) installation tools for installing a TID relative to a drum enclosure assembly. In addition, the present subject matter is also directed to TIDs and tamper-indicating assemblies, as well as related systems and methods for installing TIDs relative to drum enclosure assemblies.

Figure 2:
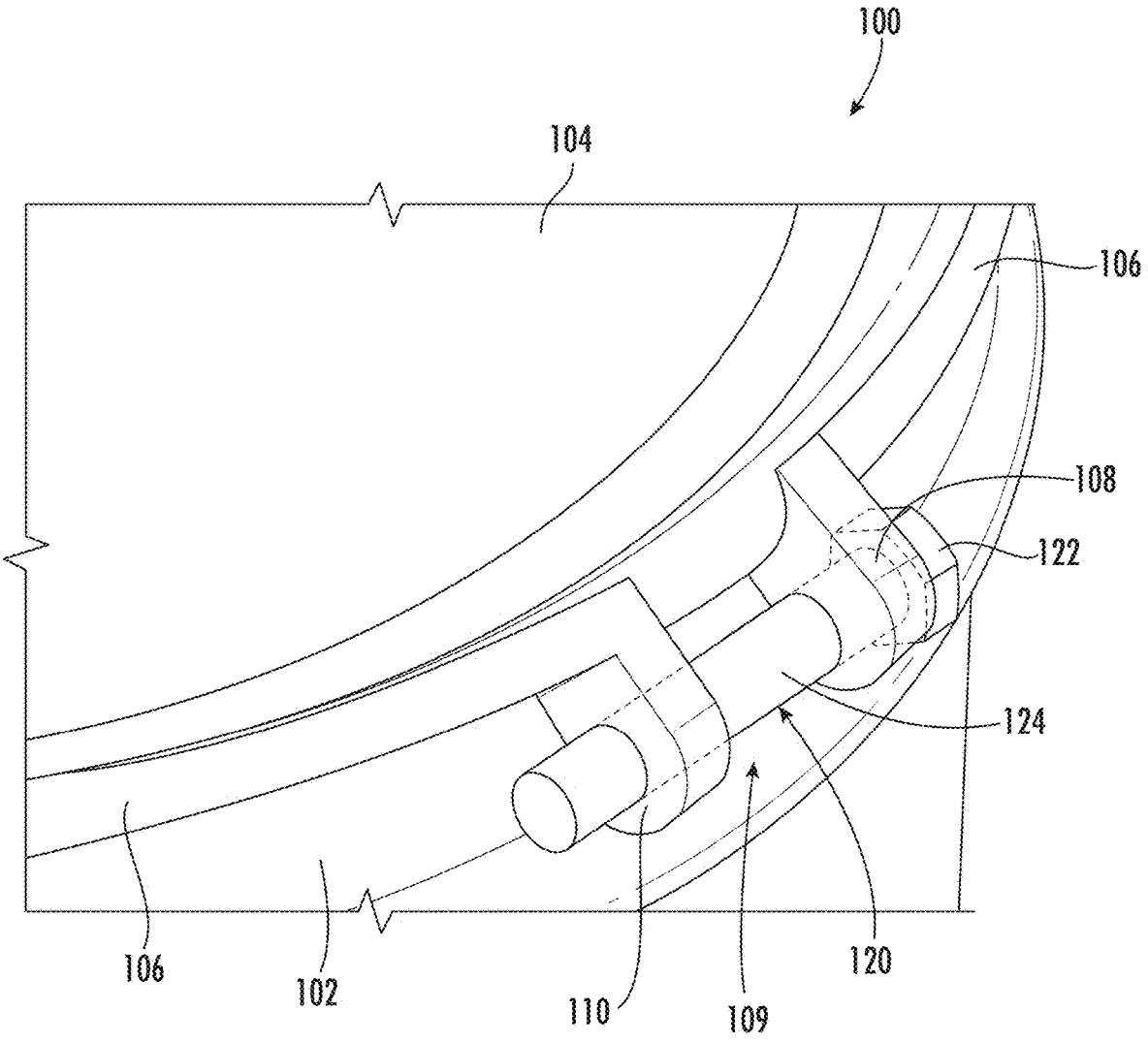
FIG. 2 illustrates an enlarged view of an aspect of the drum enclosure assembly of FIG. 1 in accordance with aspects of the present subject matter.

Referring now to the drawings, FIGS. 1 and 2 illustrate views of one embodiment a drum enclosure assembly 100 in accordance with aspects of the present subject matter. Specifically, FIG. 1 illustrates a perspective view of the drum enclosure assembly 100, while FIG. 2 illustrates an enlarged perspective view of the drum enclosure assembly 100.

As shown, the drum enclosure assembly 100 may include a drum body 102, a lid 104, and a lid ring 106 securing the lid 104 to the drum body 102. For example, the drum body 102 may define one or more open ends, and the lid 104 may be disposed on the open end of the drum body 102 such that the lid 104 and the drum body 102 collectively define an enclosed interior (e.g., which may be used for storage or shipment of one or more products). The lid ring 106 may extend (e.g., annularly about an axial centerline 172 of the drum enclosure assembly 100) from a first flanged end 108 to a second flanged end 110. The first flanged end 108 and the second flanged end 110 may be spaced apart from one another such that a gap 109 is defined therebetween. A closure bolt 120 having a head 122 and a body 124 may extend through the first flanged end 108 and the second flanged end 110. For example, the body 124 of the closure bolt 120 may define exterior threads, and the flanges may define internal threads such that rotation of the closure bolt 120 relative to the flanged ends 108, 110 adjusts the width of the gap 109 defined between the flanged ends 108, 110. In this way, the closure bolt 120 may be rotated to adjust the width of the gap 109 between the flanged ends 108, 110, which in turn increases the pressure applied by the lid ring 106 onto the lid 104 and the drum body 102, thereby securely coupling the lid 104 to the drum body 102. Thus, the closure bolt 120 couples the lid ring 106 and the lid 104 to the drum body 102, and the removal of the closure bolt 120 allows the lid 104 to be removed and the interior of the drum body 102 to be accessed.

Figure 4:
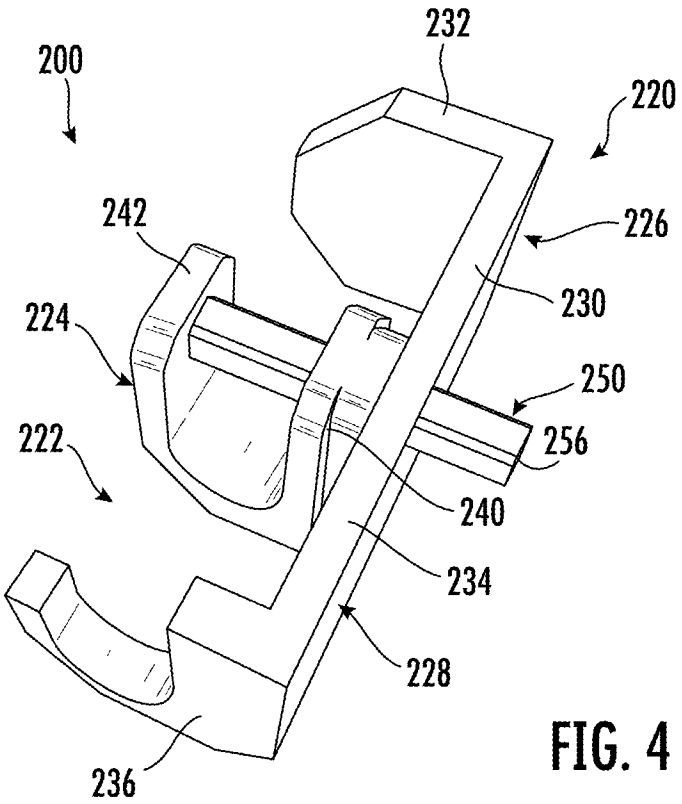
FIGS. 3-5 illustrate various views of one embodiment of a tamper-indicating assembly in accordance with aspects of the present subject matter.
Figure 3:
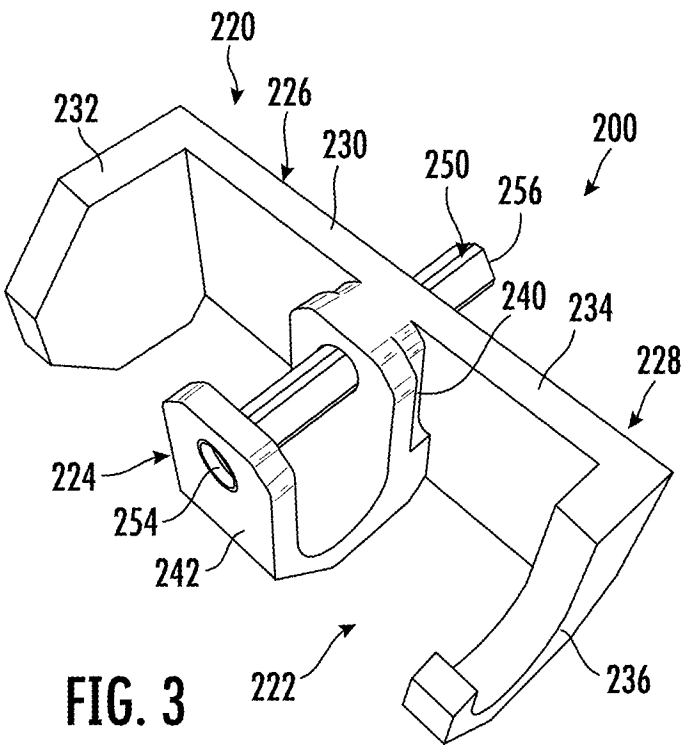
Figure 5:
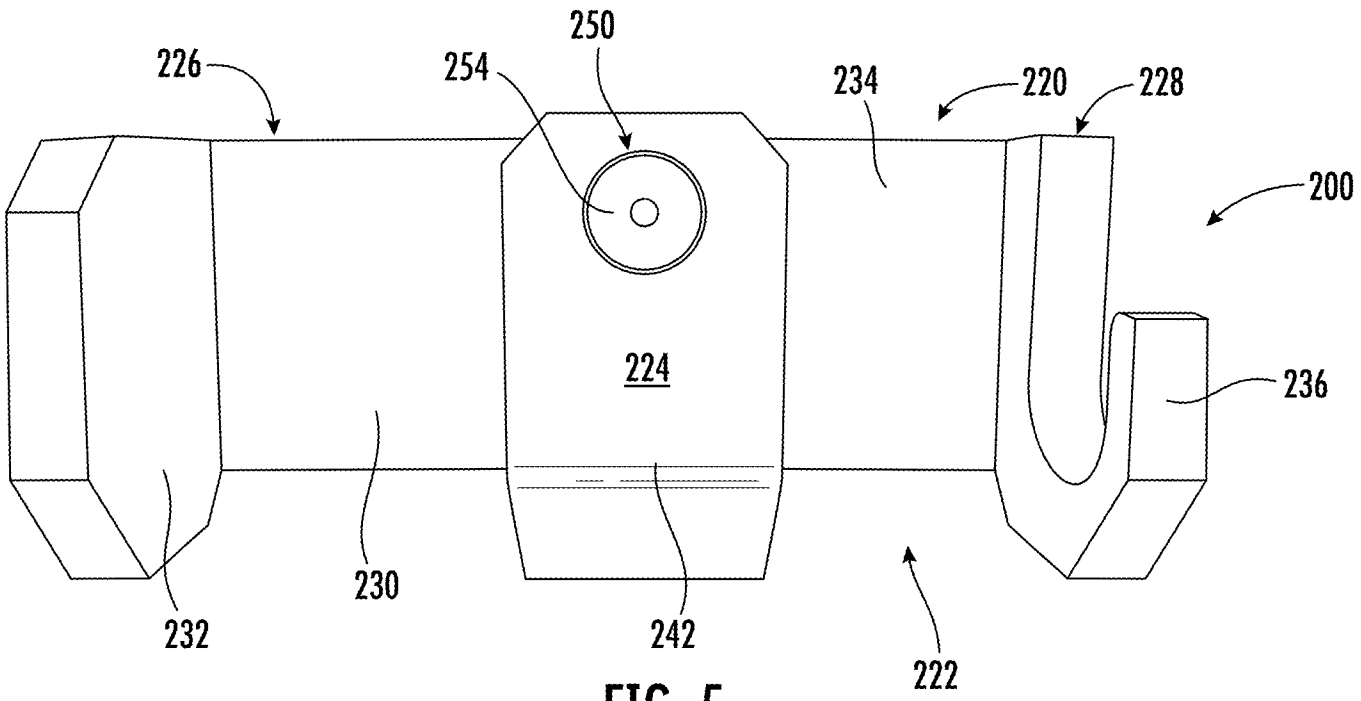
Figure 6:
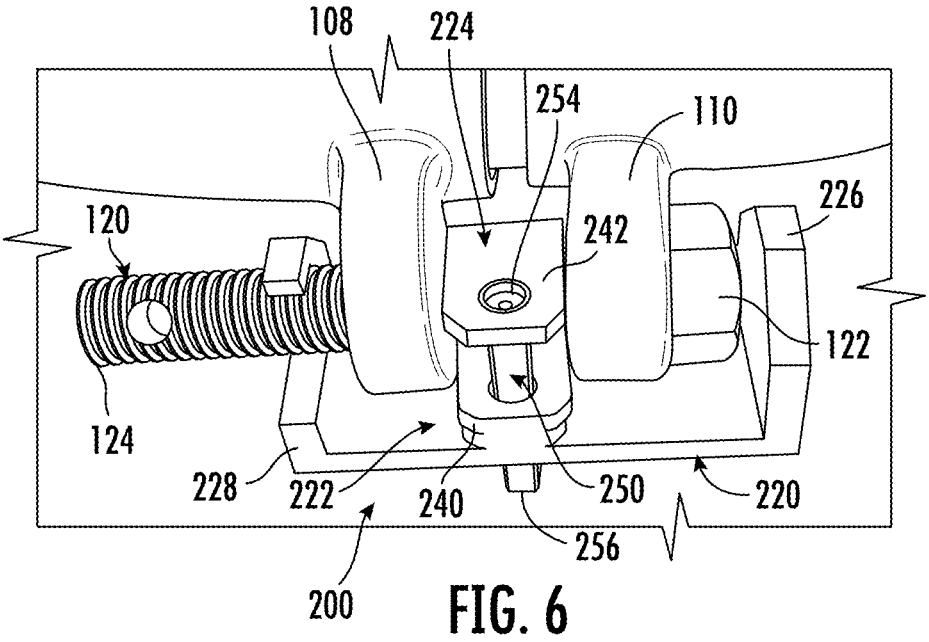
FIGS. 6-9 illustrate various views of the tamper-indicating assembly shown in FIGS. 3-5 as installed relative to a drum enclosure assembly in accordance with aspects of the present subject matter.
Figure 7:
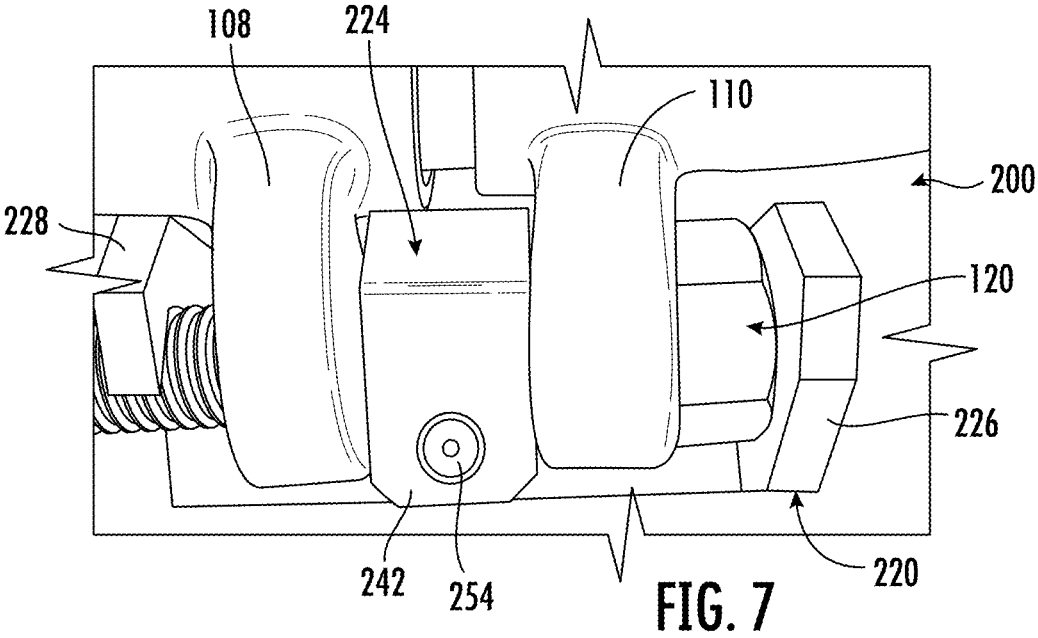
Figure 8:
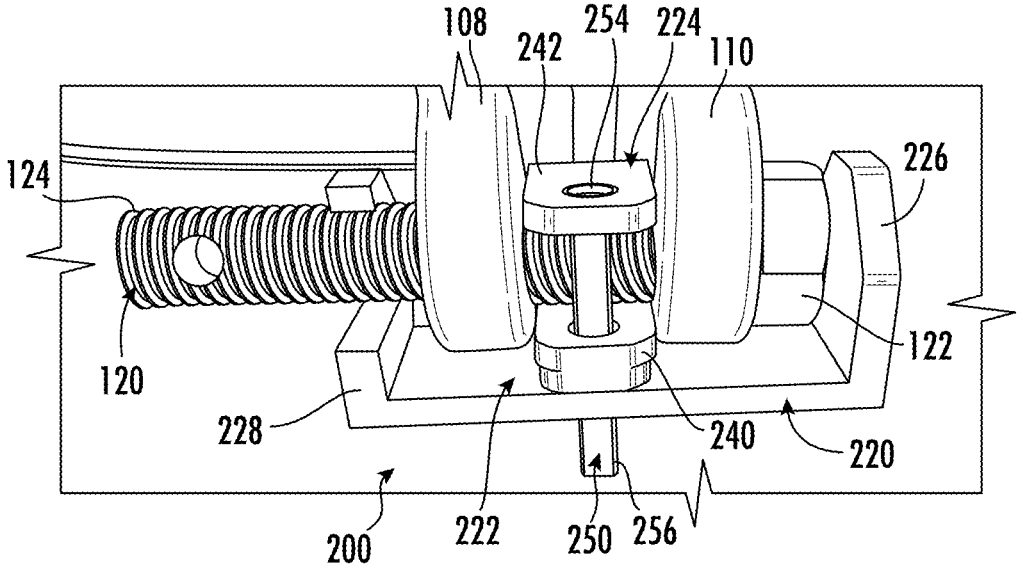
Figure 9:
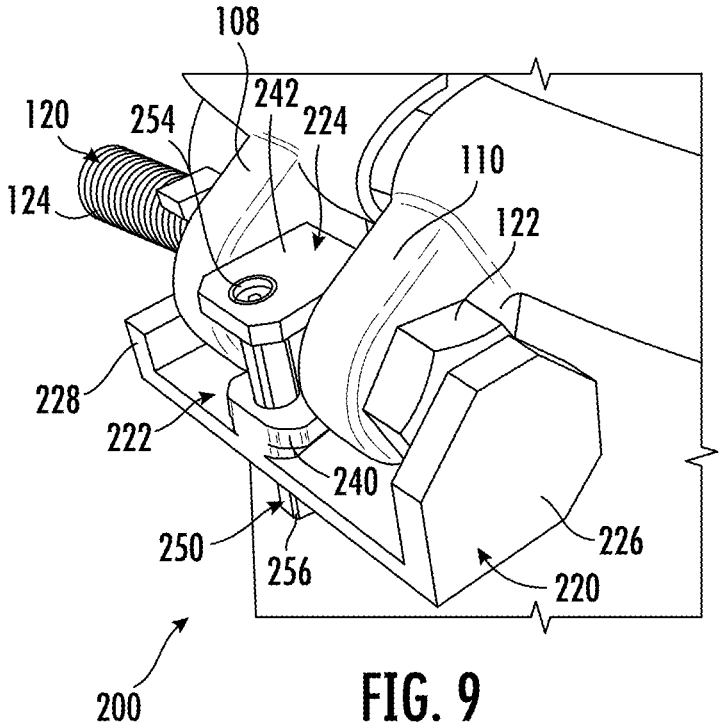
Figure 10:
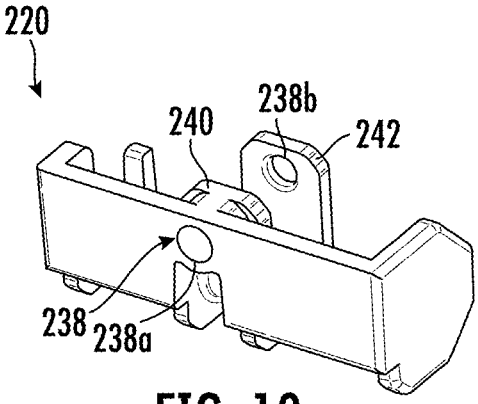
FIGS. 10-15 illustrate various views of one embodiment of a TID suitable for use within embodiments of the disclosed tamper-indicating assembly in accordance with aspects of the present subject matter.
Figure 11:
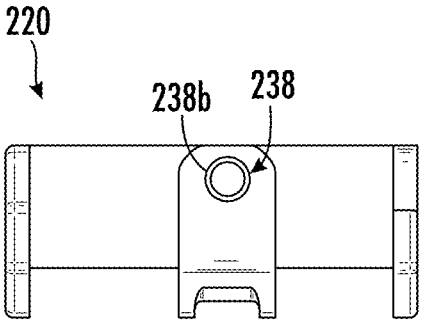
Figure 12:
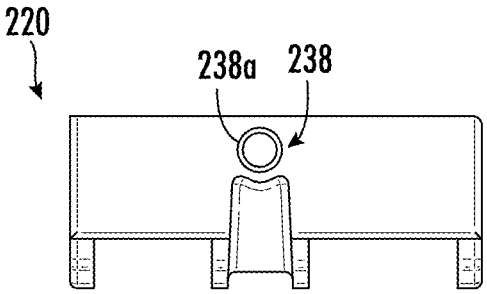
Figure 13:
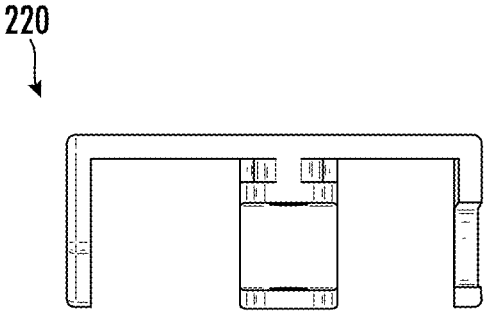
Figure 14:
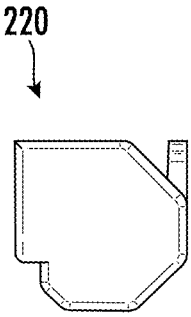
Figure 15:
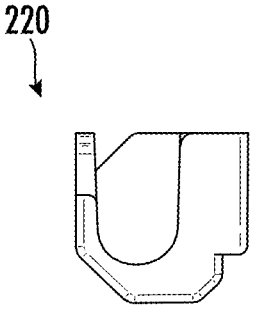

Referring now to FIGS. 3-15, various views of components of one embodiment of a tamper-indicating assembly 200 that can be installed/applied relative to a drum enclosure assembly (e.g., the drum enclosure assembly 100 of FIG. 1) are illustrated in accordance with aspects of the present subject matter. Specifically, FIGS. 3-5 illustrate various views of the tamper-indicating assembly 200 alone, while FIGS. 6-9 illustrate various views of the tamper-indicating assembly 200 installed relative to a drum enclosure (e.g., drum enclosure assembly 100), particularly illustrating the tamper-indicating assembly 200 installed relative to the closure bolt 120 and flanged ends 108, 110 of the lid ring 106. Additionally, FIGS. 10-15 illustrate various views of a TID 220 of the tamper-indicating assembly 200 shown in FIGS. 3-9. Specifically, FIG. 10 illustrates a perspective view of the TID 220 and FIGS. 11 and 12 illustrate respective top and bottom views of the TID 220. FIG. 13 illustrate a side view of the TID 220, while FIGS. 14 and 15 illustrate respective first and second end views of the TID 220.

As shown in FIGS. 3-9, the tamper-indicating assembly 200 generally includes a TID 220 and a pin 250 configured to be coupled to a drum enclosure assembly 100. In exemplary embodiments, the tamper-indicating assembly 200 may be non-removably coupled to the drum enclosure assembly 100. For example, as should be appreciated, once the tamper-indicating assembly 200 is coupled to the drum enclosure assembly 100, it may not be removed without being destroyed (e.g., partially destroyed or entirely destroyed), thereby indicating to any subsequent handlers that the drum enclosure has been tampered with and potentially opened.

In several embodiments, the TID 220 may define a cavity 222 sized to receive at least a portion of the closure bolt 120, as well as the first and second flanged ends 108, 110 of the lid ring 106, to prevent movement of the closure bolt 120. For example, the TID 220 may surround the closure bolt 120 and the flanged ends 108, 110 of the lid ring 106 in order to prevent the closure bolt 120 from being moved or removed from the drum enclosure assembly 100 without destruction of at least a portion of the tamper-indicating assembly 200. For example, as shown in FIGS. 6-9, at least a portion of the closure bolt 120, the lid ring 106, and/or other components of the drum enclosure assembly 100 may extend into the cavity 222 of the TID 220 (e.g., when the TID 220 is coupled to the drum enclosure assembly 100). In various embodiments, the cavity 222 of the TID 220 may correspond with or match a shape of at least a portion of the drum enclosure assembly 100 such that at least a portion of the drum enclosure assembly 100 may extend into the cavity 222 and make flush contact (e.g., continuous contact) with the TID 220.

In particular embodiments, the pin 250 may be non-removably coupled to the TID 220 such that it cannot be removed without destroying either or both of the pin 250 and/or the TID 220. Particularly, the pin 250 may extend through the TID 220 and across the cavity 222 such that the TID 220 and the pin 250 collectively surround the closure bolt 120 when attached to the drum enclosure assembly 100. In this way, the pin 250 ensures that the tamper-indicating assembly 200 may not be removed from the drum enclosure assembly 100 once coupled thereto.

Referring particularly to FIGS. 3-5, the TID 220 may include a mid-body portion 224, a first arm 226 extending from the mid-body portion 224, and a second arm 228 extending from the mid-body portion 224 opposite the first arm 226. The mid-body portion 224 of the TID 220 may be disposed between the first arm 226 and the second arm 228, and both the first arm 226 and the second arm 228 may extend from the mid-body portion 224. The mid-body portion 224 may be sized to receive a portion of the closure bolt 120. For example, the mid-body portion 224 may be generally U-shaped, and a portion of the body 124 of the closure bolt 120 may extend through the portion of the cavity 222 defined by the U-shaped mid-body portion 224 of the TID 220. Stated otherwise, the mid-body portion 224 of the TID 220 may at least partially surround a portion of the body 124 of the closure bolt 120. Particularly, when coupled to the drum enclosure assembly 100, the mid-body portion 224 of the TID 220 may be disposed between the first and second flanged ends 108, 110 of the lid ring 106 and may at least partially surround a portion of the body 124 of the closure bolt 120.

Both the first arm 226 and the second arm 228 may extend from the mid-body portion 224 of the TID 220 in opposite directions. For example, the first arm 226 may extend from the mid-body portion 224 and at least partially surround the first flanged end 108 of the lid ring 106 and the head 122 of the closure bolt 120, and the second arm 228 may extend from the mid-body portion 224 and at least partially surround the second flanged end 110 of the lid ring 106 and the body 124 of the closure bolt 120.

In exemplary embodiments, the first arm 226 may include an axial portion 230 (FIGS. 3 and 4) and a radial wall 232 (FIGS. 3 and 4) that prevents axial movement of the closure bolt 120. For example, the axial portion 230 of the first arm 226 may extend generally axially from the mid-body portion 224 of the TID 220 to the radial wall 232. Particularly, when installed relative to the drum enclosure assembly 100, the axial portion 230 may extend from the mid-body portion 224, along the first flanged end 108 of the lid ring 106 and the head 122 of the closure bolt 120, to the radial wall 232. The radial wall 232 may prevent axial movement of the closure bolt 120 (e.g., the radial wall 232 may prevent the closure bolt 120 from being moved or removed without destruction of a portion of the tamper-indicating assembly 200). For example, the radial wall 232 may contact the head 122 of the closure bolt 120 to prevent the closure bolt 120 from being moved or removed from the flanged ends 108, 110 of the lid ring 106. Particularly, the radial wall 232 may extend generally perpendicularly to the axial centerline of the tamper-indicating assembly 200. The radial wall 232 impedes or blocks the closure bolt 120 from being removed (e.g., unless the tamper-indicating assembly 200 is destroyed). For example, attempting to remove the closure bolt 120 while the tamper-indicating assembly 200 is in place would result in contact between the head 122 and the radial wall 232. If enough force is applied to the closure bolt 120, the radial wall 232 will be permanently destroyed, thereby indicating to users thereafter that the drum enclosure assembly 100 has potentially been opened and is unsafe to handle.

In many embodiments, the second arm 228 may extend opposite the first arm 226 and may be configured to at least partially surround the second flanged end 110 of the lid ring 106 and the body 124 of the closure bolt 120. For example, the second arm 228 may include an axial portion 234 (FIGS. 3 and 4) and a radial portion 236 (FIGS. 3 and 4). Particularly, when installed relative to the drum enclosure assembly 100, the axial portion 234 of the second arm 228 may extend from the mid-body portion 224, along the second flanged end 110 of the lid ring 106, to the radial portion 236 of the second arm 228. As shown, the radial portion 236 of the second arm 228 may be generally perpendicular to the axial portion 234 of the second arm 228 and may contact the closure bolt 120. In exemplary embodiments, the first and second flanged ends 108, 110 of the lid ring 106, along with the head 122 of the bolt 120, may be disposed between the radial wall 232 of the first arm 226 and the radial portion 236 of the second arm 228, in order to prevent removal of the closure bolt 120 when the tamper-indicating assembly 200 is coupled to the drum enclosure assembly 100. In various embodiments, the radial portion 236 of the second arm 228 may be generally U-shaped and may at least partially surround the body 124 of the closure bolt 120. For example, the U-shaped radial portion 236 of the second arm 228 allows the TID 220 to securely couple to the drum enclosure assembly 100 regardless of the excess length of the body 124 of the closure bolt 120 extending from the second flanged end 110 of the lid ring 106. Additionally, the radial portion 236 of the second arm 228 may extend adjacent to the second flanged end 110 of the lid ring 106, such that movement (or an attempted removal) of the closure bolt 120 would result in the head 122 of the closure bolt 120 engaging the radial wall 232 of the first arm 226, and in turn, the radial portion 236 of the second arm 228 engaging the second flanged end 110 of the lid ring 106.

As shown in FIGS. 3-9, the pin 250 may be inserted through a portion of the TID 220 to couple the tamper-indicating assembly 200 to the drum enclosure assembly 100. Specifically, in several embodiments, the TID 220 may define a bore 238 (See FIGS. 10-12) for receiving the pin 250. For example, the bore 238 may be a drilled or formed hole/aperture (e.g., a through-hole) having a generally cylindrical shape that extends at least partially through the TID 220. In particular embodiments, the bore 238 may be defined in the mid-body portion 224 of the TID 220. For example, the bore 238 may include a first portion 238*a* (FIG. 10) defined in a first side wall 240 of the mid-body portion 224 and a second portion 238*b* (FIG. 10) defined in a second side wall 242 of the mid-body portion 224. The first and second portions 238*a*, 238*b* of the bore 238 may be coaxially aligned (such that the center point of the holes is along a common axis). As shown in FIGS. 3 and 5-9, once the pin 250 is inserted into the bore 238, a head end 254 of the pin 250 may be exposed to allow such head end 254 to be deformed to retain the pin 250 within the bore 238. In various implementations, the pin 250 may extend through the first side wall 240, across the cavity 222, and into the second side wall 242.

Figure 18:
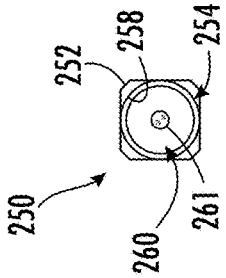
FIGS. 16-20 illustrate various views of one embodiment of a pin suitable for use within embodiments of the disclosed tamper-indicating assembly in accordance with aspects of the present subject matter.
Figure 17:
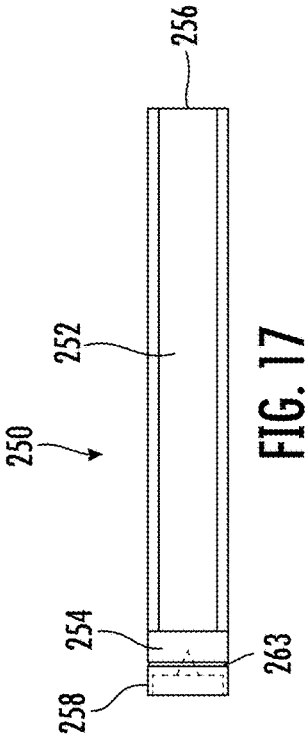
Figure 20:
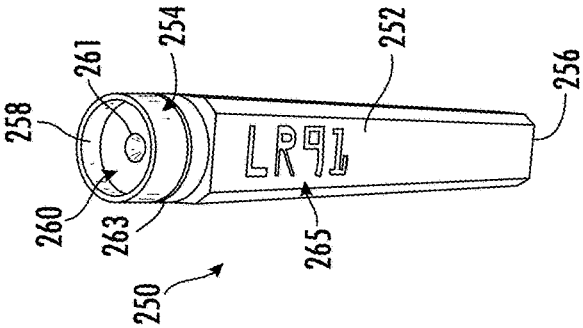
Figure 16:
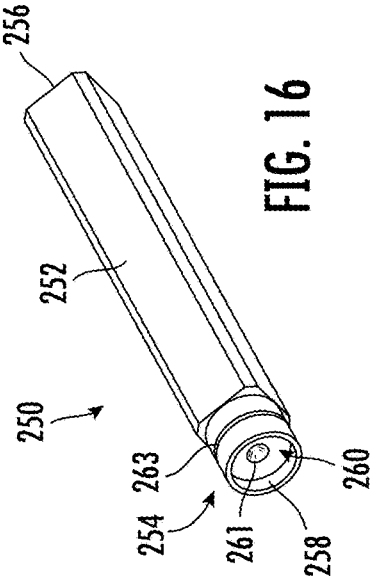
Figure 19:
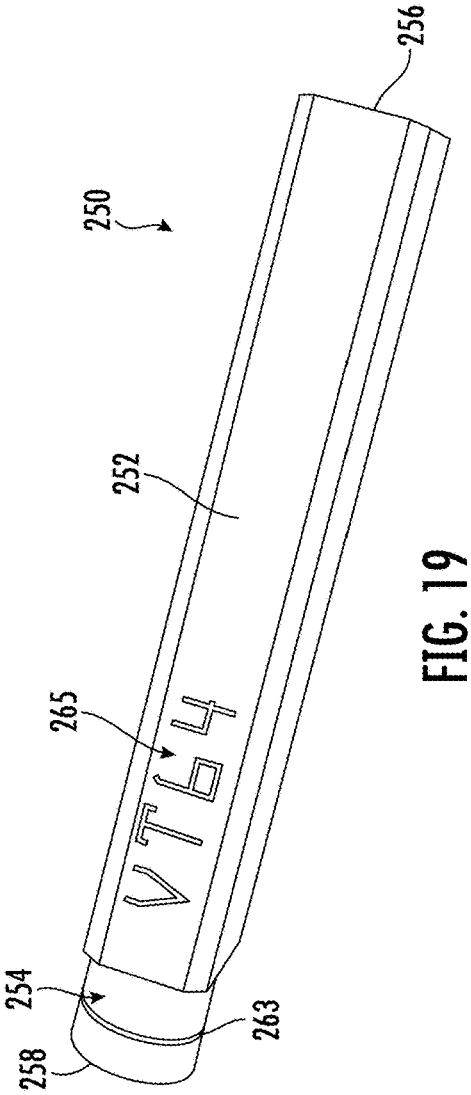

FIGS. 16-20 illustrate various views of the pin 250 of the tamper-indicating assembly 200 shown in FIGS. 3-9. Specifically, FIG. 16 illustrates a perspective view of the pin 250. FIG. 17 illustrates a side view of the pin 250, while FIG. 18 illustrates an end view of the pin 250. Additionally, FIGS. 19 and 20 illustrate further perspective views of the pin 250.

As shown in FIGS. 16-20, the pin 250 includes a body 252 extending lengthwise between a head end 254 and a body end 256. In the illustrated embodiment, the pin body 252 generally has a square cross-sectional shape with rounded or chamfered corners. However, in other embodiments, the pin body 252 may be more cylindrically shaped. As particularly shown in FIGS. 16, 18, and 20, the head end 254 of the pin 250 is generally cylindrically shaped and includes an annular flange or lip 258 extending outwardly therefrom, thereby creating a small, circular cavity 260 at the head end 254 of the pin 250. As shown in FIGS. 16-18 and 20, a small, circular tapered locating notch 261 is also centrally located within the bottom of the cavity 260. The annular lip 258 of the head end 254 may be configured to be deformed or flared outwardly to secure the pin 250 within the bore 238 of the TID 220 and prevent the pin 250 from being backed-out of or otherwise removed from the bore 238. For instance, as will be described below, a portion of the installation tool disclosed herein may be configured to be inserted or compressed into the cavity 260 to deform or flare the annular lip 258 radially outwardly into engagement with the second side wall 242 of the mid body portion 224 of the TID 220.

Additionally, an annular groove 263 may also be provided around the outer perimeter or circumference of the head end 254 of the pin 250. As particularly shown in FIG. 17, in one embodiment, the annular groove 263 may extend around the outer perimeter of the head end 254 of the pin 250 at a location slightly axially offset from the cavity 260 so as to be generally aligned with a portion of the locating notch 261 extending from the bottom of the cavity 260. As will be described below, this annular groove 263 may help to facilitate deformation of the annular lip 258 when securing the pin 250 within the TID 220.

It should be appreciated that, in several embodiments, the head end 254 of the pin 250 may define an outer dimension (e.g., an outer diameter) that is smaller than a corresponding outer dimension (e.g., a width, height, outer diameter, etc.) of at least a portion the body 252 of the pin 250. In such an embodiment, it may be desirable to select the size (e.g., diameter) of the second portion 238*b* of the bore 238 (FIG. 10) so that the head end 254 of the pin 250 may be received within the second portion 238*b* of the bore 238 but the pin body 252 (due to its larger size) cannot be received within the second portion 238*b* of the bore 238, thereby preventing the pin 250 from being pushed outwardly from the bore 238 via the second portion 238*b*. In this regard, the first portion 238*b* of the bore 238 may be sized appropriately to allow the pin body 252 to be inserted therethrough. Accordingly, the engagement of the pin body 252 against the second side wall 242 of the mid body portion 224 of the TID 220 may prevent the pin 250 from being pushed fully through the bore 238 in a first or installation direction, while the engagement of the flared lip 258 of the pin 250 along the opposed side of the second side wall 242 of the mid body portion 224 of the TID 220 may prevent the pin 250 from being pushed back out of the bore 238 in an opposed, second or retention direction.

As particularly shown in FIGS. 19 and 20, the pin 250 may, in certain embodiments, be labeled with a serial number or other identification number 265 to allow for tracking, identification, etc. For instance, during installation of the tamper-indicating assembly 200, the serial number may be captured automatically (via camera) or by a worker and logged/added to an inspection data package associated with the drum enclosure assembly 100.

Figure 21:
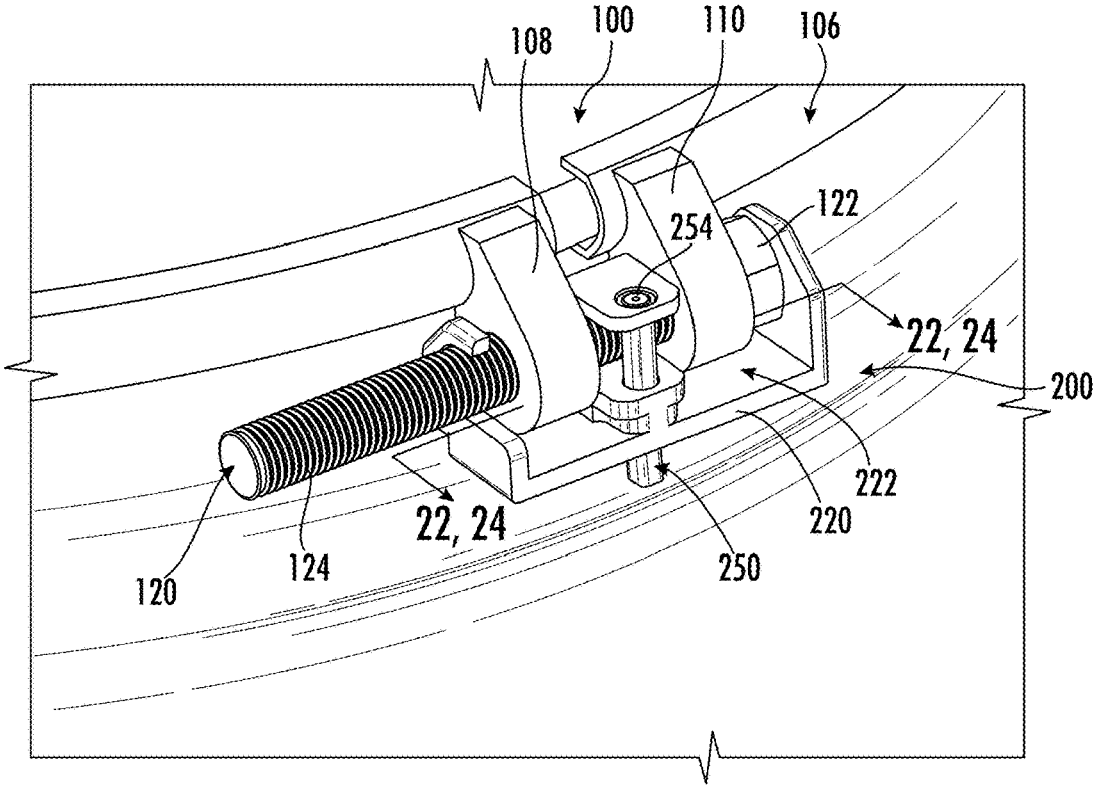
FIG. 21 illustrates a perspective of one embodiment of a tamper-indicating assembly installed relative to a drum enclosure assembly in accordance with aspects of the present subject matter.
Figure 22:
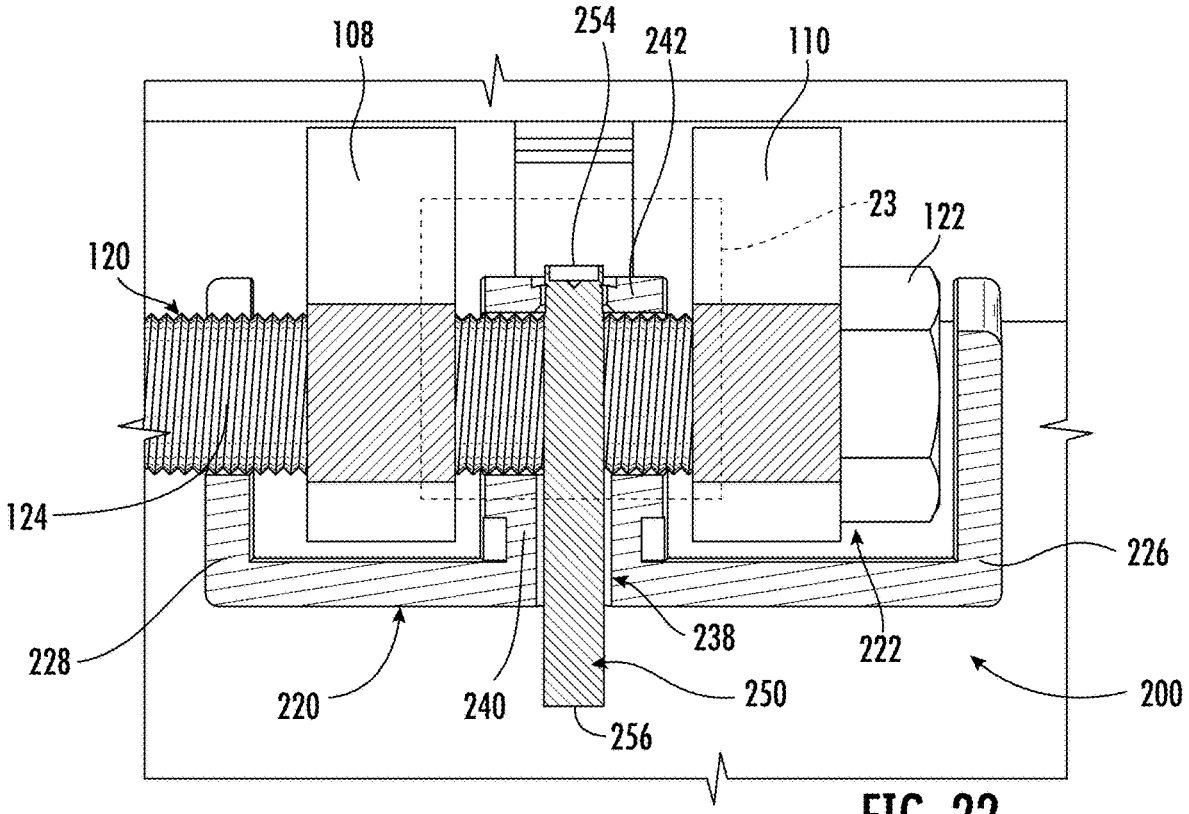
FIG. 22 illustrates a cross-sectional view of the tamper-indicating assembly shown in FIG. 21 taken about line 22, 24-22, 24, particularly illustrating the pin of the tamper-indicating assembly in a non-deformed state.
Figure 23:
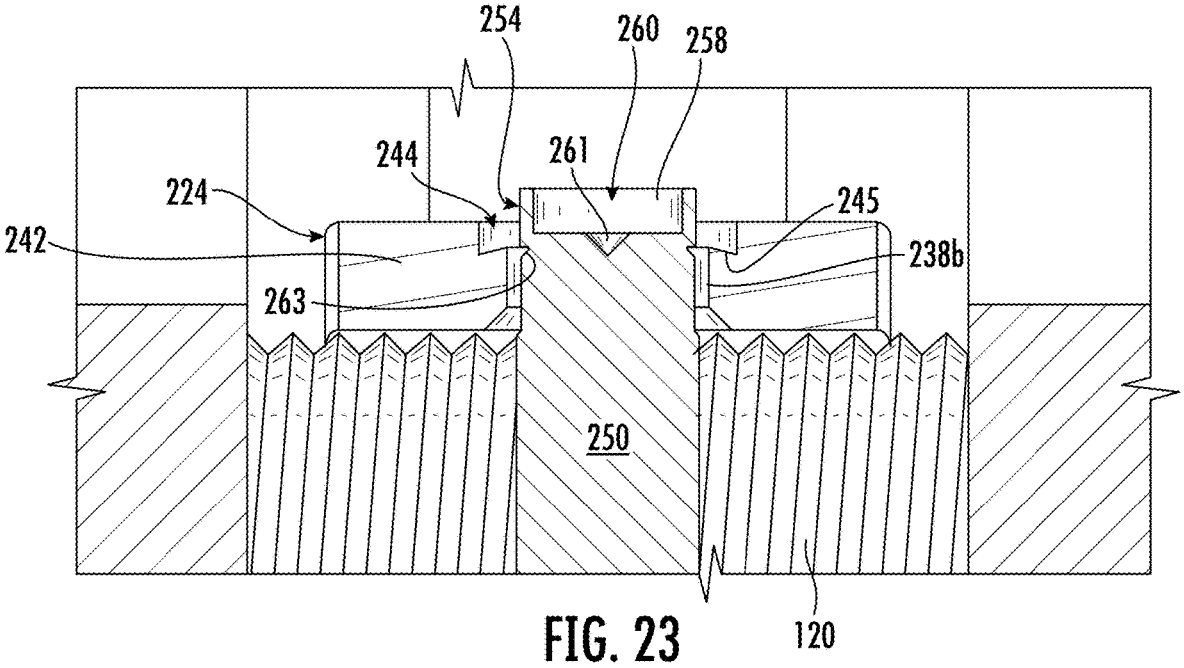
FIG. 23 illustrates an enlarged view of a portion of the tamper-indicating assembly shown in FIG. 22, particularly illustrating a head end of the pin positioned relative to an adjacent portion of a TID of the tamper-indicating assembly.

FIGS. 21-23 show additional views of the tamper-indicating assembly 200 described above as installed relative to a drum enclosure assembly 100. Specifically, FIG. 21 illustrates a partial, perspective view of the drum enclosure assembly 100 with the tamper-indicating assembly 200 installed relative thereto (and with the pin 250 of the assembly 200 in a deformed state). FIG. 22 illustrates a side, cross-sectional view of a portion of the drum enclosure assembly 100 and tamper-indicating assembly 200 shown in FIG. 21 (e.g., taken about line 22, 24-22, 24), while FIG. 23 illustrates a close-up view of the portion of the illustration of FIG. 22 shown in dashed box 23, with both FIGS. 22 and 23 illustrating the head end 254 of the pin 250 in a non-deformed state.

As shown in the illustrated embodiment, the TID 220 is shown as installed relative to the closure bolt 120 and the flanged ends 108, 110 of the lid ring 106. Additionally, as particularly shown in FIGS. 22 and 23, the pin 250 is shown installed relative to the TID 220 (i.e. by being inserted through the bore 238 of the TID 220) but prior to the annular lip 258 of the head end 254 of the pin 250 being deformed or flared outwardly to secure the pin 250 in place relative to the TID 220. For example, as particularly shown in FIG. 23, the pin 250 extends through the second side wall 242 of the mid body portion 224 of the TID 220 such that the head end 254 of the pin 250 is exposed along the exterior of the TID 220. This allows the annular lip 258 of the head end 254 to be deformed or flared outwardly via the installation tool, as will be described below in greater detail. As shown in FIG. 23, the second side wall 242 of the mid body portion 224 of the TID 220 defines a small, recessed cavity 244 surrounding the head end 254 of the pin 250, with the cavity forming a retention shoulder 245 (e.g., an angled retention shoulder) within the second side wall 242 of the mid body portion 224. As will be described below, the annular lip 258 is generally configured to be deformed or flared radially outwardly into this recessed cavity 244 such that the lip 258 radially overlaps the retention shoulder 245, thereby ensuring that the pin 250 cannot backout of the bore 238 due to the engagement between the lip 258 and the retention shoulder 245 (i.e., thus, securing the pin 250 within the TID 220).

Figure 24:
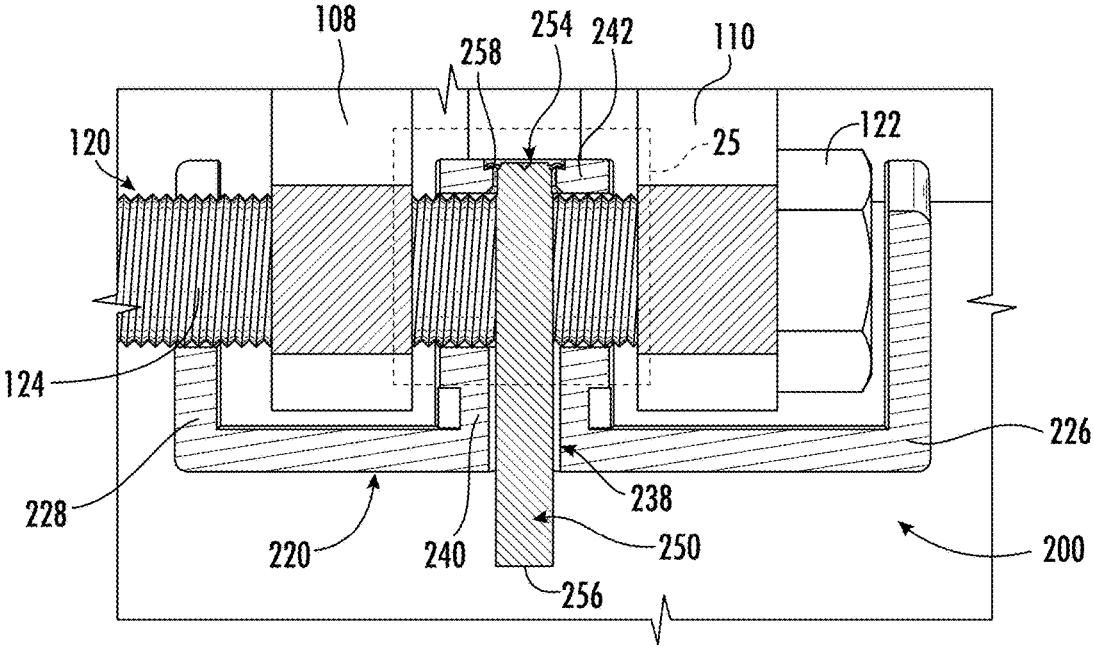
FIG. 24 illustrates a cross-sectional view of the tamper-indicating assembly shown in FIG. 21 taken about line 22, 24-22, 24, particularly illustrating the pin of the tamper-indicating assembly in a deformed state.
Figure 25:
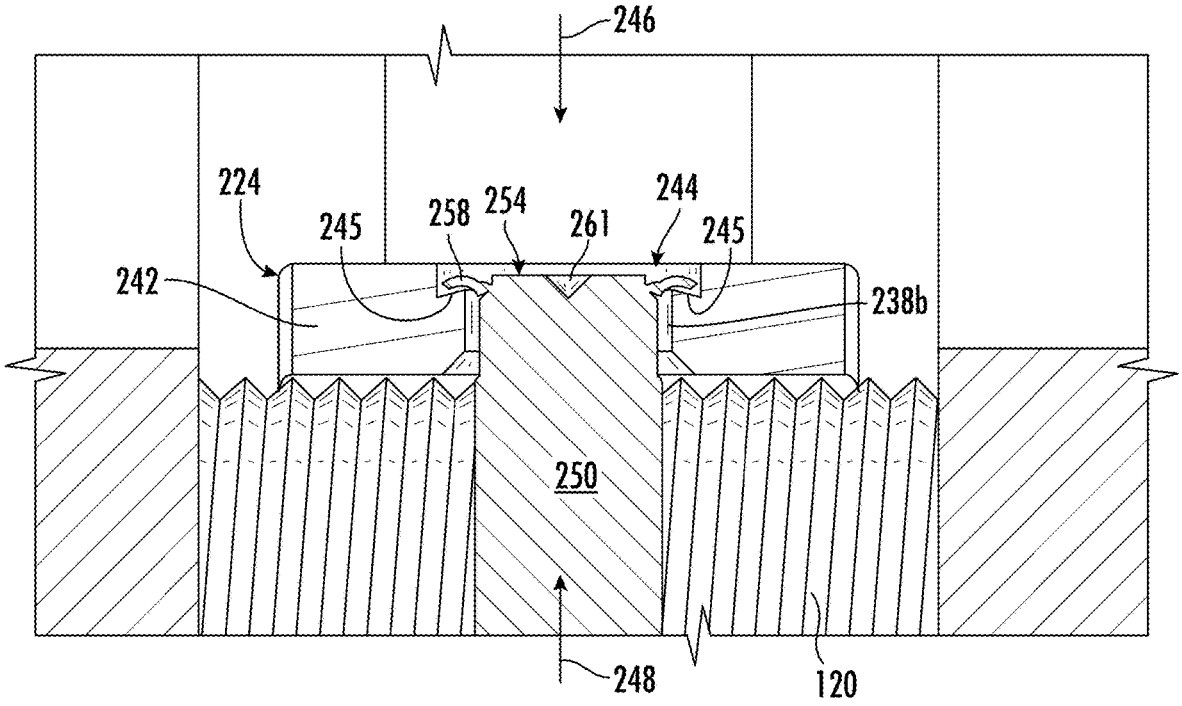
FIG. 25 illustrates an enlarged view of a portion of the tamper-indicating assembly shown in FIG. 24, particularly illustrating a head end of the pin positioned relative to an adjacent portion of a TID of the tamper-indicating assembly.

FIGS. 24 and 25 illustrate similar views as those shown above in FIGS. 22 and 23, respectively, except that the head end 254 of the pin 250 is illustrated in the deformed state. Specifically, FIG. 24 illustrates a side, cross-sectional view of a portion of the drum enclosure assembly 100 and tamper-indicating assembly 200 shown in FIG. 21 (e.g., taken about line 22, 24-22, 24), while FIG. 25 illustrates a close-up view of the portion of the illustration of FIG. 24 shown in dashed box 25, with both FIGS. 24 and 25 illustrating the head end 254 of the pin 250 in the deformed state.

As particularly shown in FIGS. 24 and 25, upon deformation of the annular lip 258 of the head end 254 of the pin 250, the lip 258 is flared or deformed radially outwardly such that the lip 258 radially overlaps the retention shoulder 245 of the second side wall 242 of the mid body portion 224 of the TID 220. As a result, the engagement between the deformed lip 258 and the retention shoulder 245 will prevent the pin 250 from backing out or otherwise being removed from the bore 238 in a pin retention direction of the TID 220 (indicated by arrow 246 in FIG. 25). Additionally, as described above, the outer dimension (e.g., a width, height, outer diameter, etc.) of the body 252 of the pin 250 may be sized such that the body 252 cannot be received into the smaller sized second portion **238*b* of the bore 238. As such, the engagement of the pin body 252 against the second side wall 242 of the mid body portion 224 of the TID 220 may prevent the pin 250 from being pushed through the bore 238 in a pin installation direction of the TID 220 (indicated by arrow 248 in FIG. 25). Accordingly, the engagement of the pin 250 along the opposed sides of the second side wall 242 (e.g., via the flared lip 258 and the enlarged pin body 252) may function to secure the pin 250 in place relative to the TID 220**.

Figure 26:
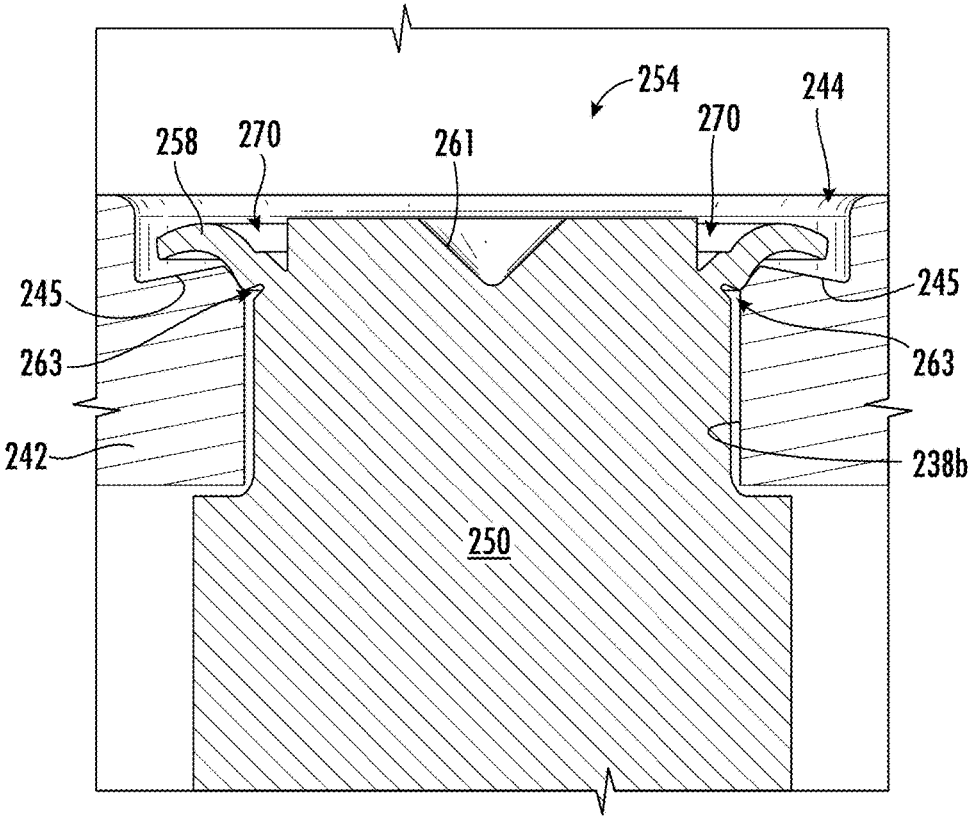
FIG. 26 illustrates an even further enlarged view of the head end of the pin shown in FIG. 25, particularly illustrating aspects of a deformed lip of the head end of the pin.

FIG. 26 illustrates a close-up, cross-sectional view of a portion of the second side wall 242 of the TID 220 and the pin 250 shown in FIGS. 24 and 25, particularly illustrating a more detailed view of the flared lip 258 in its deformed state. As shown in FIG. 26, the deformed lip 258 extends outwardly and radially overlaps the retention shoulder 245 defined by the second side wall 242 of the TID 220. In one embodiment, the deformed lip 258 may take on a curled or curved profile in the deformed state, which may result from the deformation process (as will be described below).

It should be appreciated that the annular groove 263 formed around the outer perimeter of the pin 250 may function to facilitate deformation or flaring of the lip 258 outwardly during the deformation process. As described above (and as particularly shown in FIG. 17), the annular groove 263 is generally formed around the outer perimeter of the pin 250 at a location immediately below the bottom end of the cavity 260 defined in the head end 254 of the pin 250 (e.g., at a location axially aligned with a portion of the locating notch 261) such that the groove 263 is positioned adjacent or immediately below the location at which the annular lip 258 intersects the bottom end of the cavity 260. Such placement of the groove 263 allows the pin material extending between the bottom end of the lip 258 and the cavity 260 to be displaced into the groove 263 as the lip 258 is flared outwardly. For instance, as shown in FIG. 26, with the lip 258 in its deformed state, a portion of the groove 263 is occupied by pin material that has been deformed or displaced during the deformation process, thereby allowing for proper outward flaring or deformation of the lip 258.

Additionally, it should also be appreciated that the groove 263 may also function to create a weak point below the lip 258 due to the reduced wall thickness, thereby providing a location at which a crack or break can form in the head end 254 of the pin 250 to further facilitate outward deformation or flaring of the lip 258. For instance, as shown in FIG. 26, a small failure point or break (e.g., at the location indicated by arrows 270) may occur at the intersection between the lip 258 and the bottom end of the cavity 260 to facilitate enhanced outward flaring of the lip 258.

Figure 27:
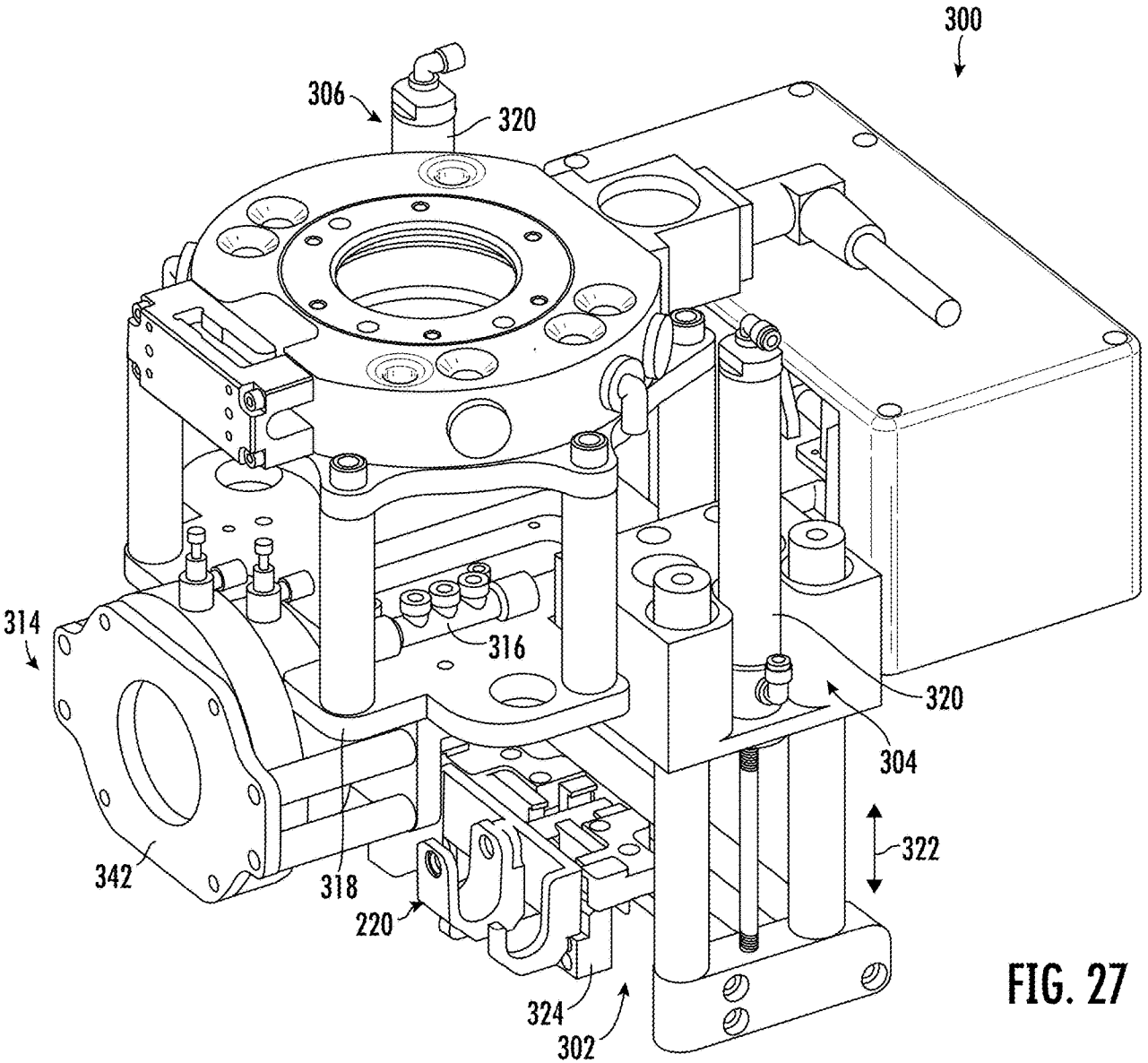
FIG. 27 illustrates a perspective view of one embodiment of a TID installation tool in accordance with aspects of the present subject matter.
Figure 28:
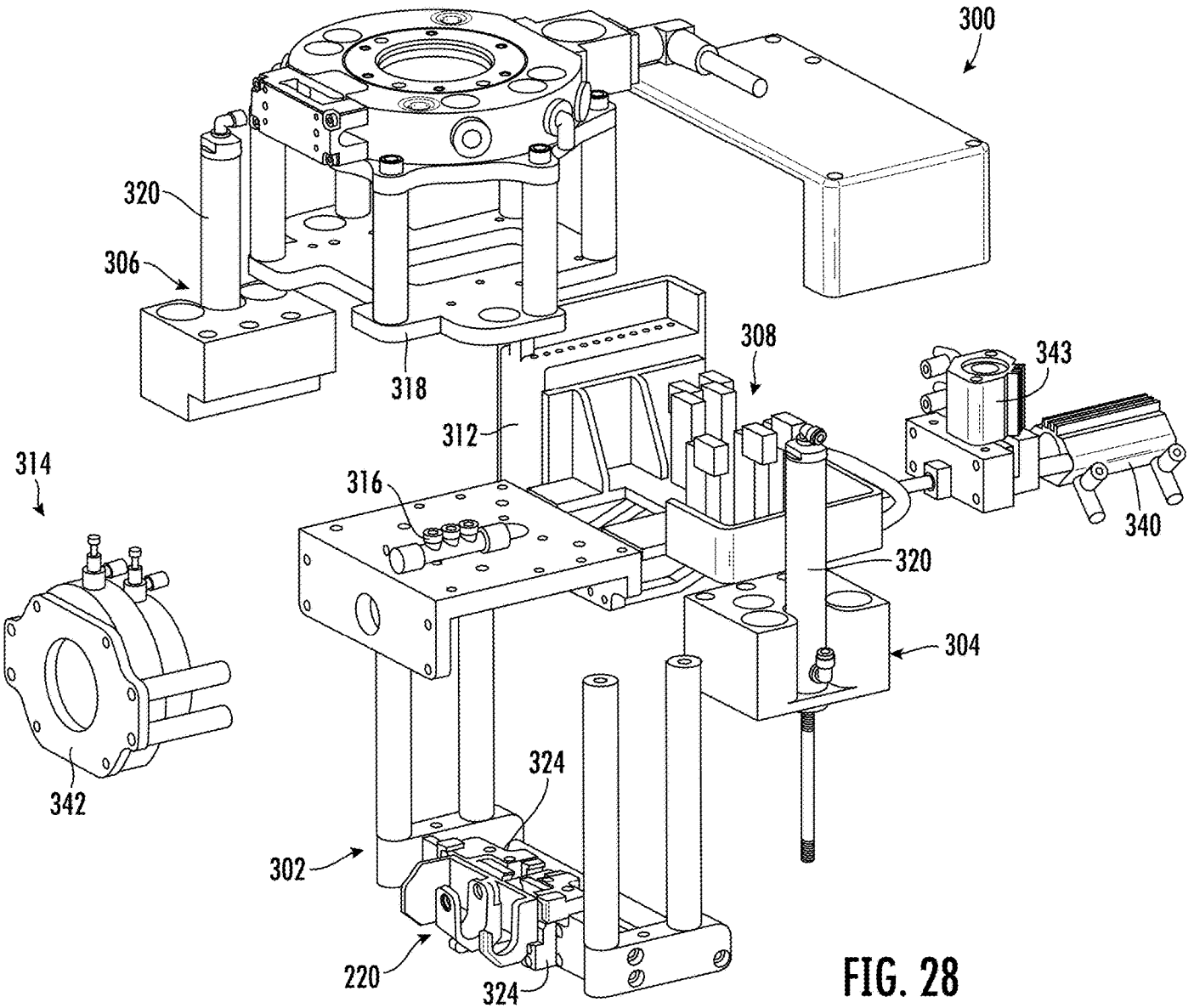
FIG. 28 illustrates a partially exploded view of the TID installation tool shown in FIG. 27.
Figure 29:
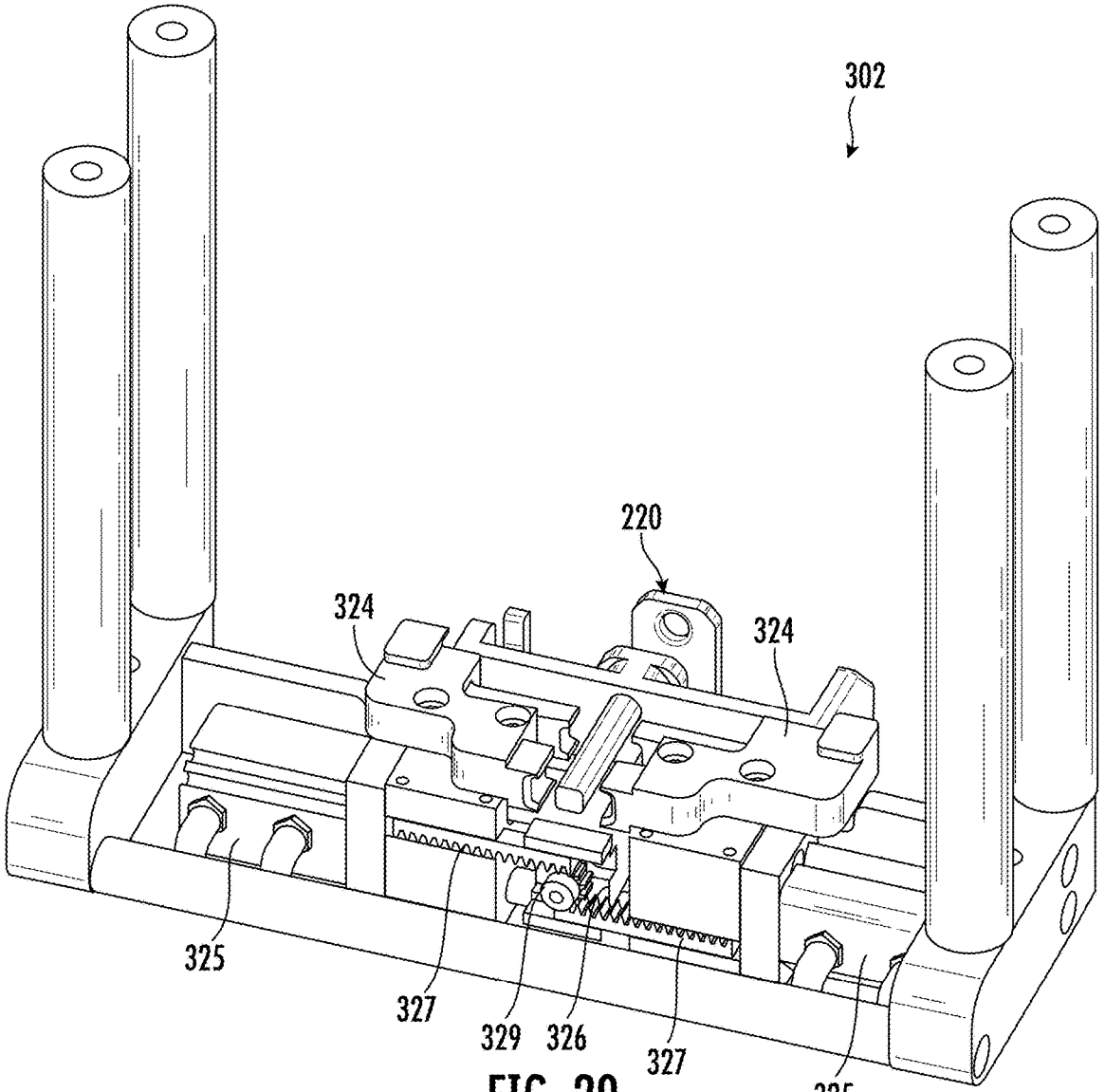
FIG. 29 illustrates a rear perspective view of a TID support assembly of the TID installation tool shown in FIGS. 27 and 28, particularly illustrating clamping blocks of the TID support assembly at an opened or non-clamped position relative to the tamper-indicating assembly.
Figure 30:
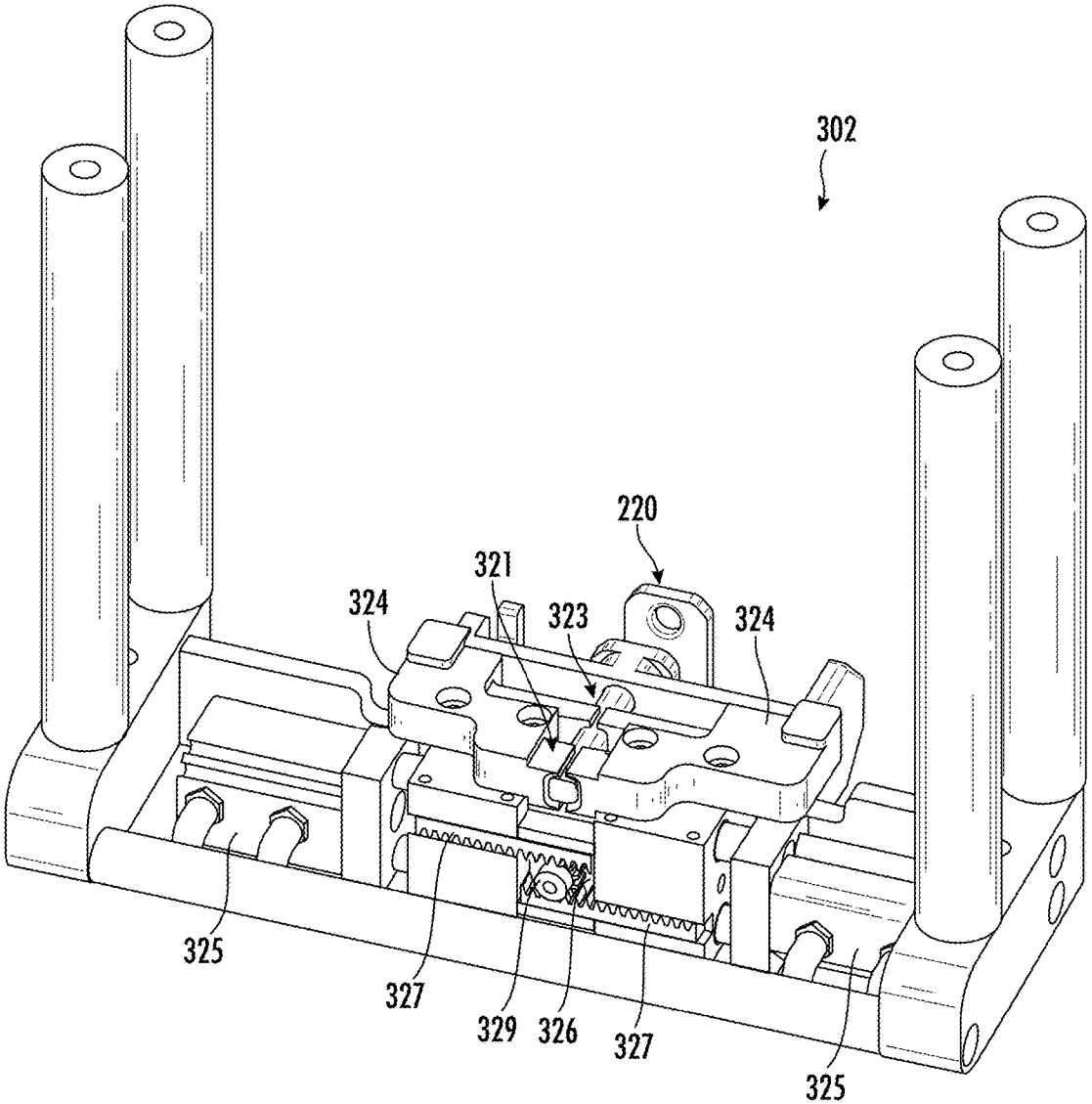
FIG. 30 illustrates another rear perspective view of the TID support assembly of the TID installation tool shown in FIGS. 27 and 28, particularly illustrating the clamping blocks of the TID support assembly at a closed or clamped position relative to the tamper-indicating assembly.

FIGS. 27-30 illustrate differing views of one embodiment of a TID installation tool 300 in accordance with aspects of the present subject matter. Specifically, FIG. 27 illustrates a perspective view of the installation tool 300 with the tamper-indicating assembly 200 described above positioned relative to the tool 300, while FIG. 28 illustrates an exploded view of the TID installation tool 30 shown in FIG. 27. Additionally, FIGS. 29 and 30 illustrate rear, perspective views of a portion of the tool 300 shown in FIGS. 27 and 28 (e.g., a TID support assembly 302 of the tool 300).

As shown in FIGS. 27 and 28, the tool 300 may generally include a TID support assembly 302, first and second TID actuator assemblies 304, 306, a valve assembly 308 (e.g., a solenoid valve assembly), robot/tool adapter assembly 310, a control box 312 (FIG. 28), a pin deformation assembly 314, and a pneumatic manifold assembly 316.

The TID support assembly 302 may generally be configured to support/grip the tamper-indicating assembly 200 for installation onto the drum enclosure assembly 100. For instance, the TID support assembly 302 may include clamping features that are configured to be pneumatically actuated relative to the tamper-indicating assembly 200 to allow the tool 300 to pick-up and support the tamper-indicating assembly 200. For instance, as shown in FIGS. 28-30, opposed clamping blocks 324 may be provided along either side of the TID support assembly 302 for clamping against the opposed ends of the TID 220 (e.g., against the radial walls/portions 232, 236 of the first and second arms 226, 228 of the TID 220). As particularly shown in FIGS. 29 and 30, the clamping blocks 324 may also be configured to clamp around portions of the pin 250 to maintain the pin 250 in place relative to the TID 220 (e.g., prior to full insertion of the pin 250 through the bore 238 of the TID 220) and to maintain proper alignment of the pin 250 relative to the bore 238 during insertion of the pin 250 therein.

As particularly shown in FIGS. 29 and 30, to facilitate actuation of the clamping blocks 324 between a non-clamped position (see FIG. 29) and a clamped position (see FIG. 30), the TID support assembly 302 may also incorporate first and second clamp actuators 325 (e.g., pneumatic actuators) configured to actuate the clamping blocks 324 via a gearbox 326 to ensure that the clamping blocks 324 are pneumatically actuated inwardly at the same rate when clamping the tamper-indicating assembly 200. For instance, the clamp actuators 325 may be coupled to the gearbox 326 via racks 327 that engage a pinion gear 329 of the gearbox 326 such that linear actuation of the racks 327 (e.g., see the transition between FIGS. 29 and 30), rotationally drive the pinion gear 329 to facilitate actuation of the clamping blocks 324 between the non-clamped and clamped positions. As shown in FIG. 29, at the non-clamped position, the clamping blocks 324 are spaced apart from the tamper-indicating assembly 200, thereby allowing the assembly 200 to be installed between the clamping blocks 324. As shown in FIG. 30, at the clamped position, the clamping blocks 324 are engaged or clamped against the opposed ends of the TID 200 and around the outer perimeter the pin 250. In one embodiment, as shown in FIG. 30, the clamping blocks 324 may be configured to engage around or contact the pin 250 at two separate locations (e.g., first and second contact locations 321, 323) to ensure that the pin 250 is maintained coaxially aligned with the bore 238 of the TID 200.

The first and second actuator assemblies 304, 306 may generally be configured to actuate the TID support assembly 302 relative to a main frame or support structure 318 of the tool 300. For instance, each actuator assembly 304, 306 may include an actuator 320 (e.g., a pneumatic actuator) coupled between the main support structure 318 and the TID support assembly 302 for actuating the TID support assembly 302 relative to the support structure 318. For instance, as shown in FIG. 27, the actuators 320 may be configured to actuate or move the TID support assembly 302 up and down relative to the support structure 318 (e.g., in the direction of arrow 322 shown in FIG. 27). In one embodiment, each actuator 320 may be a double-acting pneumatic cylinder configured to raise and lower the TID support assembly 302 relative to the support structure 318 between an extended position (FIG. 27) and a retracted position (see FIG. 31). In the view of FIG. 27, the TID support assembly 302 is shown in an extended state (or at the extended position) relative to the support structure 318 such that the TID support assembly 302 (and the tamper-indicating assembly 200 supported therein) are spaced apart from the support structure 318 as well as the pin deformation assembly 314. However, as will be described below, by actuating the actuators 320 to raise the TID support assembly 302 upwards towards the support structure 318 into a retracted state (or at the retracted position-see FIG. 31), the tamper-indicating assembly 200 supported within the TID support assembly 320 may be brought into alignment with or otherwise properly positioned relative to the components of the pin deformation assembly 314, thereby allowing the pin 250 of the tamper-indicating assembly 200 to be subsequently deformed to secure the pin 250 within such assembly 200.

The valve assembly 308 may generally be configured to control the flow of pressurized air from the pneumatic manifold assembly 316 to each pneumatic component of the tool 300 (e.g., the clamping actuators 325 of the TID support assembly 302, the actuators 320 of the actuator assemblies 304, 306, the pin actuators 340, 342 and locking actuator 343 (described below) of the pin deformation assembly 314, etc.). Additionally, the control box 312 may house various electronic equipment and other electrical components for the tool 300.

The robot/tool adapter assembly 310 may generally be configured to allow the installation tool 300 to be coupled to a robotic arm assembly (e.g., a FANUC robotic arm). For instance, the robot/tool adapter assembly 310 may incorporate quick-change components or other features for allowing the tool 300 to be quickly and easily coupled to a robotic arm assembly. For example, the robot/tool adapter assembly 310 may allow the robotic arm assembly to couple itself to the tool 300 without any human interaction, such as by including quick or automatic connect/disconnect features.

The pin deformation assembly 314 is generally configured to press the pin 250 through the TID 220 and subsequently deform the pin 250 (i.e., by flaring the annular lip 258 outwardly relative to the TID 220) once the TID 220 has been installed relative to the drum enclosure assembly 100 using the tool 300 (and associated robotic arm assembly). As particularly shown in FIG. 28, in several embodiments, the pin deformation assembly 314 includes first and second pin actuators 340, 342 (e.g., pneumatic actuators or cylinders) configured to press the pin 250 into the TID 220 and subsequently deform the pin 250. As will be described below, when the tamper-indicating assembly 200 is installed onto the drum enclosure assembly 100 via the tool 300 and the TID support assembly 320 is in the retracted position, the pin actuators 340, 342 are generally configured to be positioned along the opposed ends 254, 256 of the pin 250 such that respective actuatable components of the pin actuators 340, 342 (e.g., a push rod 344 of the first pin actuator 340 and a deformation punch assembly 345 of the second pin actuator 346) can be actuated into and engage the ends 254, 256 of the pin 250. Additionally, in several embodiments, the pin deformation assembly 314 may also include a locking actuator 342 (e.g., a pneumatic actuator or cylinder). As will be described below, the locking actuator 342 may function to lock the push rod 344 of the first pin actuator 340 in place during the pin deformation process to ensure that the pin 250 does not back out of the bore 238 of the TID 220 as the head end 254 of the pin 250 is being deformed by the deformation punch assembly 354 of the second pin actuator 346.

Exemplary cross-sectional views of the installation tool 300 are shown in FIGS. 31-35, specifically illustrating the components of the pin deformation assembly 314 (e.g., the pin actuators 340, 342 and locking actuator 343) positioned relative to the tamper-indicating assembly 200 during the installation process. Specifically, FIG. 31 generally illustrates a cross-sectional view of the tool 300, while FIGS. 32-35 illustrate enlarged, cross-sectional views of the relative positioning of the components of the pin deformation assembly 314 and the tamper-indicating assembly 200 during the pin installation/deformation process.

Figure 31:
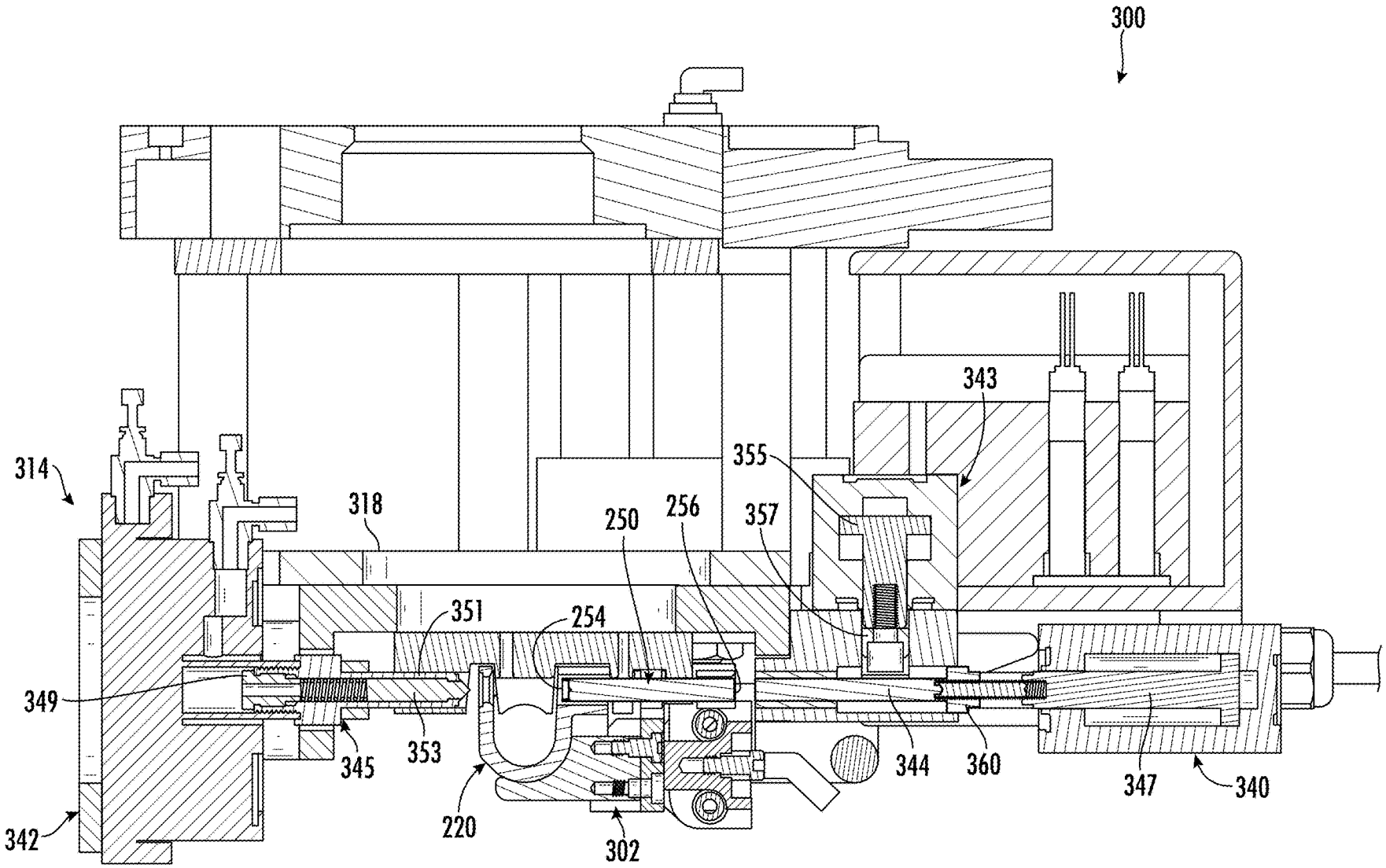
FIG. 31 illustrates a cross-sectional view of the TID installation tool shown in FIG. 27.

As shown in the cross-sectional view of FIG. 31, the TID support assembly 302 is disposed at its retracted position relative to the support structure 318 such that the actuatable components of the pin actuators 340, 342 are positioned along the opposed ends of the pin 250. Specifically, as shown in the illustrated embodiment, the first pin actuator 340 includes a push rod 344 aligned with and positioned relative to the body end 256 of the pin 250, with the push rod 344 being coupled to a respective piston 347 of the first pin actuator 340. As such, by extending the push rod 344 into engagement with the body end 256 of the pin 250 (e.g., via actuation of the corresponding piston 247), the first pin actuator 340 may be configured to push or press the pin 250 through the bore 238 of the TID 220. Additionally, as shown in the illustrated embodiment, the second pin actuator 342 includes a deformation punch assembly 345 aligned with and positioned relative to the head end 254 of the pin 250, with the punch assembly 345 being coupled to a respective piston 349 of the second pin actuator 342 to allow for actuation of the punch assembly 345 relative to the pin 250. In several embodiments, the punch assembly 345 may generally include an outer deformation punch 351 coupled to the piston 349 and a spring-loaded locating pin 353 positioned or housed within the deformation punch 351. In such embodiments, by extending the punch assembly 345 into engagement with the head end 254 of the pin 250 (e.g., via actuation of the corresponding piston 349), the punch assembly 345 may be configured to deform the head end 254 of the pin 250 to secure the pin 250 in place within the TID 220.

Figure 32:
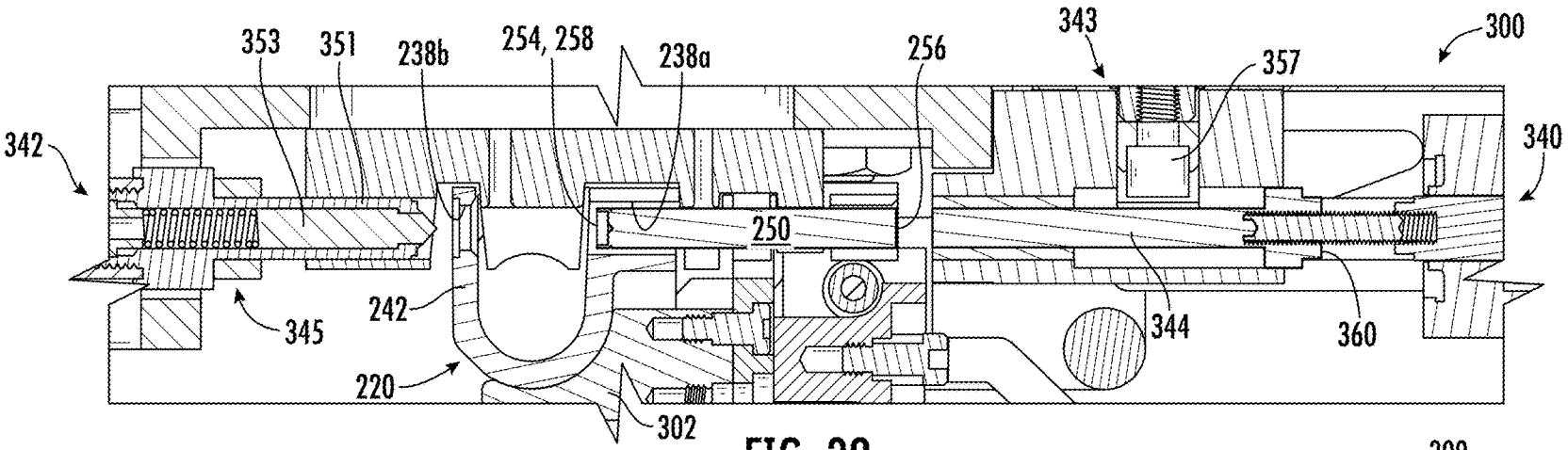
FIGS. 32-35 illustrate enlarged, cross-sectional views of portions of the TID installation tool shown in FIG. 31 during the pin installation/deformation process in accordance with aspects of the present subject matter.
Figure 33:
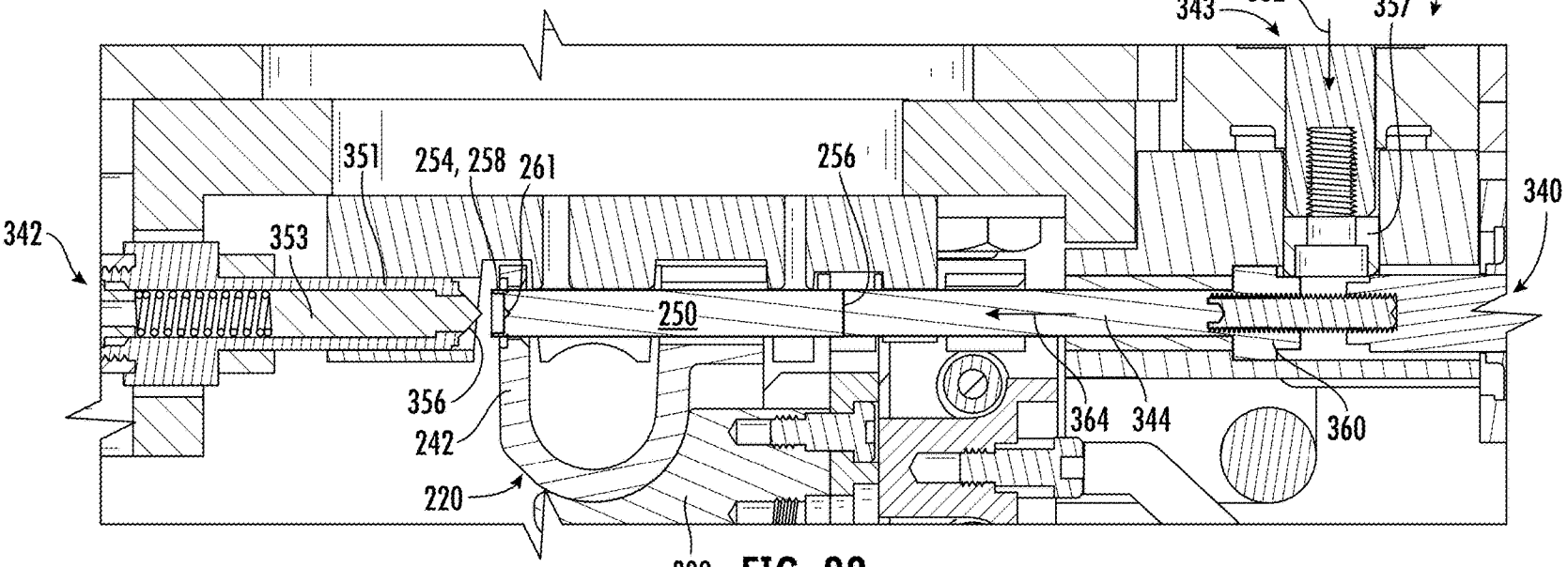

Additionally, as shown in FIG. 31, the locking actuator 343 may be oriented perpendicular to the actuation directions of the first and second pin actuators 340, 342 and may include an actuatable piston 355 and a lock tab 357 coupled to the piston 355. As described above, the locking actuator 342 may function to lock the push rod 344 of the first pin actuator 340 in place during the pin deformation process. Specifically, the push rod 344 may include an annular locking shoulder 360 extending radially outwardly therefrom that is configured to be engaged by the lock tab 357 when the push rod 344 is moved to an extended position (e.g., as shown in FIG. 33) to push the pin 250 through the bore 238 of the TID 220. For example, as shown in FIGS. 31 and 32, when the push rod 344 is at its initial retracted position, the locking shoulder 360 may be positioned on the non-TID side of the locking actuator 343 (e.g., to the right of the lock tab 357). However, when the push rod 344 is actuated to push the pin 250 through the bore 238, the locking shoulder 360 shifts to the TID side of the locking actuator 343 (e.g., to the left of the lock tab 357). At such position, the locking actuator 243 may be actuated (e.g., in the direction shown by arrow 362 in FIG. 33) so that the locking tab 357 engages against the back end of the locking shoulder 360, thereby preventing the push rod 344 from retracting as the second pin actuator 342 is being actuated against the pin 250 to deform the lip 258.

As particularly shown in the transition between FIGS. 32 and 33, when initially pressing the pin 250 into the TID 220, the first pin actuator 340 may be actuated such that the push rod 344 is pushed into the body end 256 of the pin 250 (e.g., in a first actuation direction indicated by arrow 364 in FIG. 33), thereby pressing the pin 250 through the bore 238 until the body 252 contacts or engages against the inner side of the second side wall 242 of the mid body portion 224 of the TID 220, at which point the head end 254 of the pin 250 is exposed along the opposed outer side of the second side wall 242 of the mid body portion 224 of the TID 220. In this regard, it should be appreciated that the pin 250 may be positioned in a partially installed state relative to the TID 220 when the tamper-indicating assembly 200 is initially picked-up and clamped by the tool 300 (e.g., via the TID support assembly 302). For instance, as shown in FIG. 32, the pin 250 may be initially installed relative to the TID 220 such that the pin 250 is received within the first portion **238*a* of the bore 238 but does not extend outwardly into the cavity 222 of the TID 220, thereby allowing the TID 220 to be installed relative to the closure bolt 120 and flanged ends 108, 110 of the lid ring 106 of the drum enclosure assembly 100**.

Figure 34:
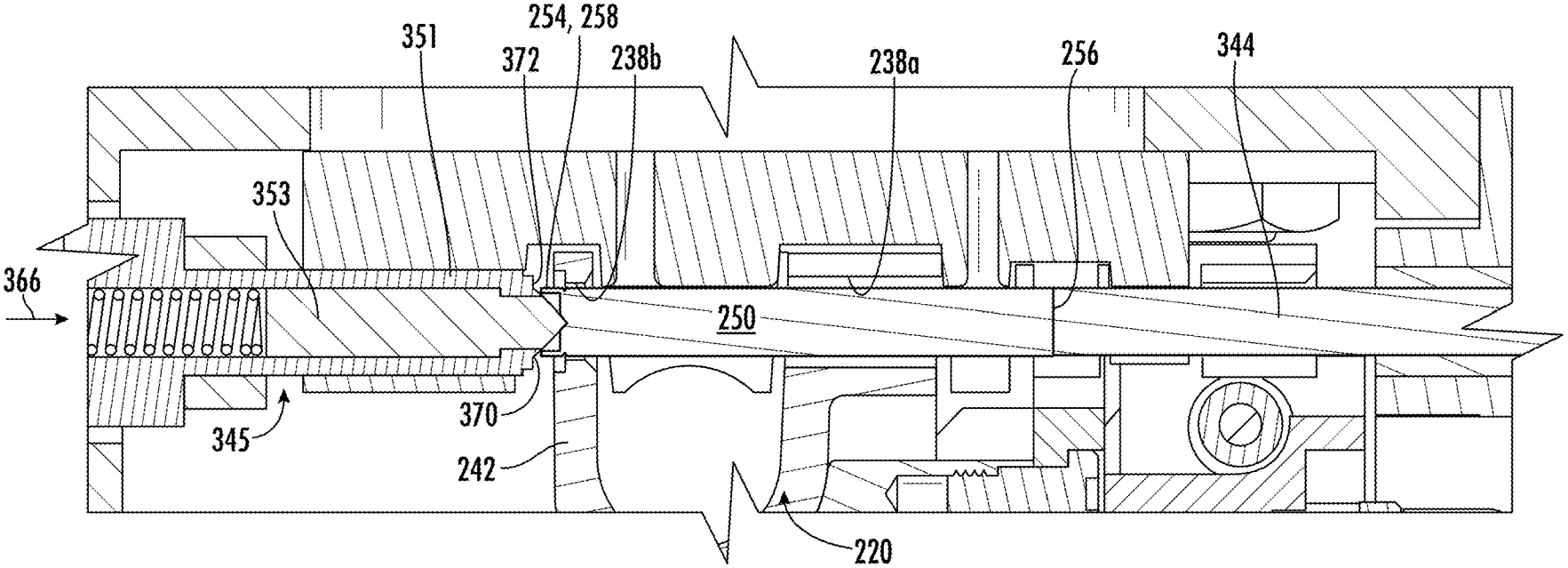
Figure 35:
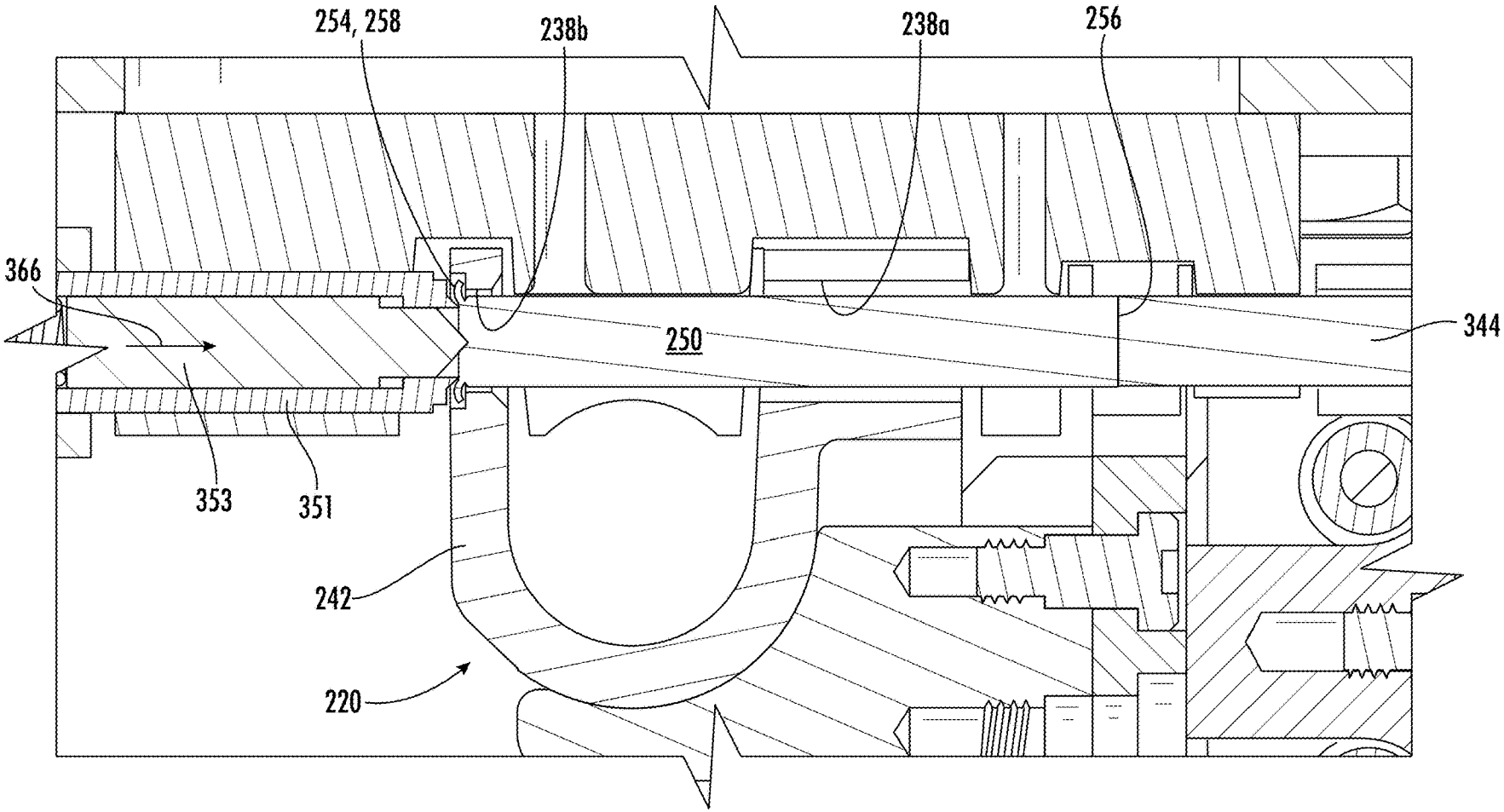
Figure 36:
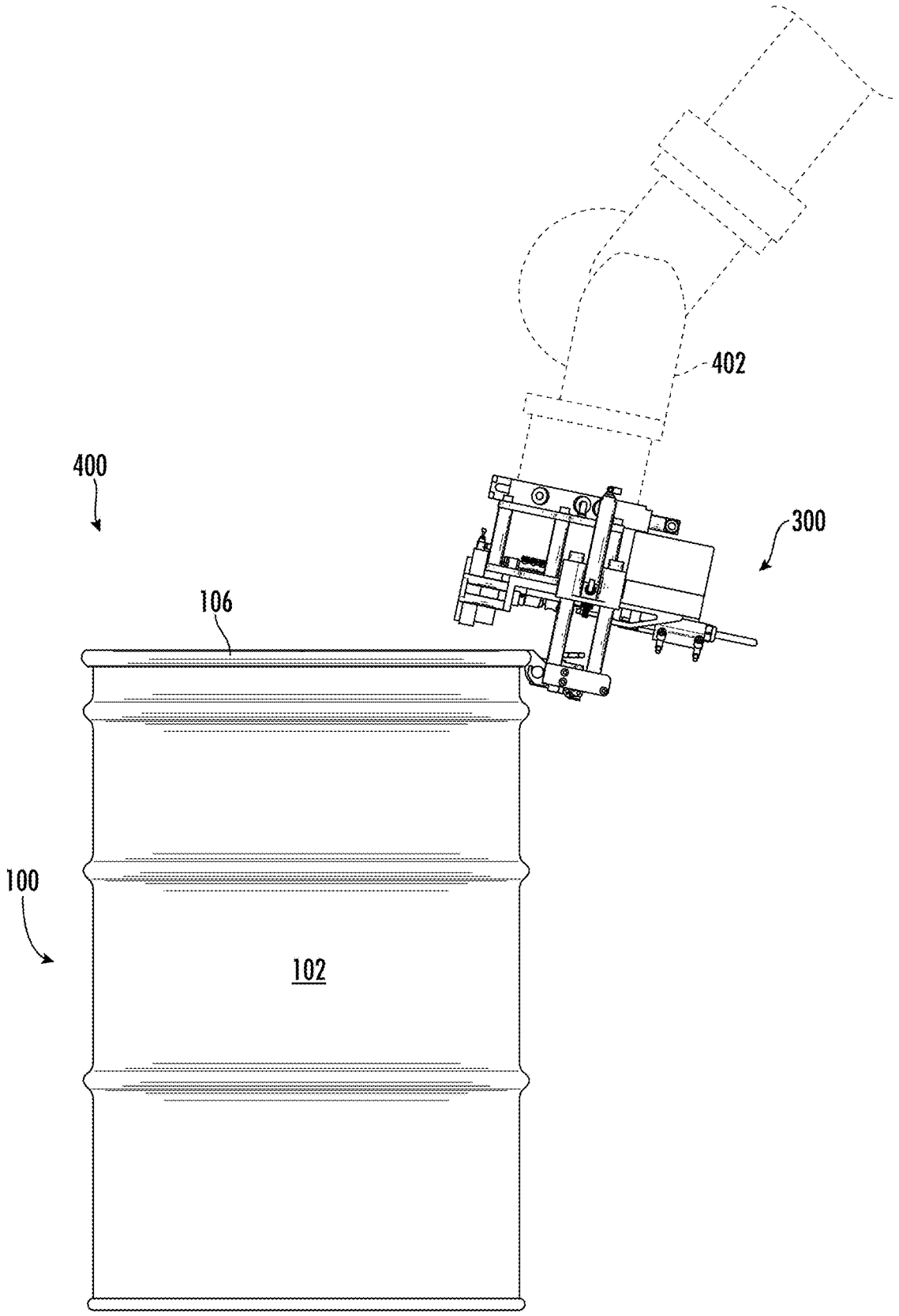
FIG. 36 illustrates a side view of one embodiment of a system for installing a tamper-indicating assembly relative to a drum enclosure assembly, particularly illustrating a TID installation tool of the system being positioned relative to the drum enclosure assembly via an associated robotic arm.

Once the pin 250 has been pressed fully into the bore 238, the push rod 344 of the first pin actuator 340 is maintained in engagement against the body end 256 of the pin 250 via the operation of the locking actuator 343 (e.g., via the locking engagement between the locking tab/shoulder 357, 360) while the deformation punch assembly 345 of the second pin actuator 342 is actuated into and against the head end 254 of the pin 250 (e.g., in a second actuation direction indicated by arrows 366 in FIGS. 34 and 35), thereby allowing the pin to be "compressed" between the push rod 344 and the punch assembly 345 of the first and second pin actuators 340, 342, respectively. As particularly shown in the transition between FIGS. 33 and 34, upon initial actuation of the punch assembly 345 in the second actuation direction 366, the spring-loaded locating pin 353 may initially contact the head end 254 of the pin 250 to ensure that the punch assembly 345 is properly aligned with the pin 250. Specifically, as shown in FIGS. 33 and 35, a locating end 356 (FIG. 33) of the pin 353 may be configured as a pointed end (e.g., having a pyramidal shape) that is configured to be received within the complementarily shaped locating notch 261 defined in the bottom end of the cavity 260 of the head end 254 of the pin 250. Such engagement between the locating pin 353 and the pin 250 (i.e., via the locating notch 261) ensures proper alignment and centering of the pin 250 relative to the punch assembly 345 (particularly the outer deformation punch 351 of the assembly 345).

As particularly shown in the transition between FIGS. 34 and 35, upon further actuation of the punch assembly 345 in the second actuation direction 366, the deformation punch 351 of the assembly 345 is configured to be brought into contact with the annular lip 258 of the head end 254 of the pin 250, thereby allowing the punch 351 to deform or flare the lip 28 radially outwardly. For example, as shown in FIG. 34, a conical-shaped distal end 370 of the punch 351 may be configured to include a short conical portion extending from the distal end 370 to a deflection shoulder 372 of the punch 351, with the deflection shoulder 372 being generally oriented perpendicular to the actuation direction 366. As shown in the illustrated embodiment, the conical-shaped distal end 370 of the punch 351 defines an outwardly tapered or ramped profile such that the diameter of the punch 351 increases as the punch 351 extends away from its distal end 370 towards the deflection shoulder 372. In such an embodiment, as the punch 351 is being actuated into engagement with the head end 251 of the pin 250, the distal end 370 of the punch 351 may be received within the cavity 260 defined at the head end 241 of the pin 250 (e.g., at a location adjacent to the inner perimeter of the annular lip 258) such that the lip 258 contacts the tapered or ramped profile of the distal end 370, thereby causing the lip 258 to begin to flare outwardly as the lip 258 rides radially outwardly along such tapered or ramped profile. As the punch 351 is further actuated relative to the pin 259 in the second actuation direction 366, the lip 258 contacts the deflection shoulder 372 of the punch 351 extending radially outwardly from the distal end 370 of the punch 351, which causes the lip 258 to be deformed radially outwardly as it rides along the deflection shoulder 372. For example, as shown in FIG. 35, the lip 258 may have a tendency to curl outwardly as the distal end 370 of the punch 351 is pressed further against the pin 250 due to the contact between the lip 258 and the deflection shoulder 372 of the punch 351. As described above with reference to FIGS. 24-26, in this deformed state, the lip 258 may radially overlap with the retention should 245 defined by the second side wall 242 of the TID 220, thereby locking the pin 250 in place within the TID 220. Upon deforming the lip 258 to such deformed state, the push rod 344 and punch assembly 345 of the first and second pin actuators 340, 342, respectively, may be retracted (e.g., via retraction of the respective pistons 347, 349 of the actuators 340, 342) away from the tamper-indicating assembly 200 (e.g., to the initial positions shown in FIG. 31).

FIGS. 36-39 illustrate various views of the installation tool 300 and a drum enclosure assembly 100 during the TID installation process. The general installation process will now be described with reference such figures. Additionally, FIGS. 36-39 generally illustrate various views of one embodiment of a system 400 for installing a tamper-indicating assembly 200 relative to a drum enclosure assembly in accordance with aspects of the present subject matter.

Initially, the installation tool 300 (as equipped or installed on an associated robotic arm assembly 402 (indicated by dashed lines) of the system 400) picks-up a tamper-indicating assembly 200 (including the TID 220 and the pin 250 partially installed relative to the TID 220). For example, the robotic arm assembly 402 may be used to position the installation tool 300 relative to the tamper-indicating assembly 200 such that the clamp blocks 324 of the TID support assembly 302 are positioned along the opposed ends or sides of the tamper-indicating assembly 200. The clamp blocks 324 may then be pneumatically actuated to clamp the tamper-indicating assembly 200 therebetween. The robotic arm assembly 402 and the installation tool 300 are then used to install the tamper-indicating assembly 200 relative to the drum enclosure assembly 100, i.e., by positioning the TID 220 relative to the flanged ends 108, 110 of the lid ring 106 and the closure bolt 120 such that the flanged ends 108, 110 and the bolt 120 are received within the cavity 222 of the TID 220 (e.g. (1) with the flanged ends 108, 110 being positioned between the radial walls/portions 232, 236 of the first and second arms 226, 228 of the TID 220; and (2) with the head 122 of the bolt 120 being positioned adjacent to the radial wall 232 of the first arm 226 and the body of the bolt 120 extending through both the mid body portion 224 of the TID 220 and the radial portion 236 of the second arm 226 of the TID 220). In positioning the tamper-indicating assembly 200 relative to the drum enclosure assembly 100, the robotic arm assembly 402 may be configured to orient the installation tool in the orientation shown in FIGS. 36 and 37. Specifically, the robotic arm assembly 402 is configured to initially position the tool 300 (in the orientation shown in FIGS. 36 and 37) relative to the drum enclosure assembly 100 such that the tamper-indicating assembly 200 is positioned immediately below the closure bolt 120 and flanged ends 108, 110 of the lid ring 106. The robotic arm assembly 402 may then raise the installation tool 300 (and the tamper-indicating assembly 200 supported thereby) such that the closure bolt 120 and flanged ends 108, 110 are received within the cavity 222 of the TID 220 (which is unobstructed given the partially installed state of the pin 250)

Figure 37:
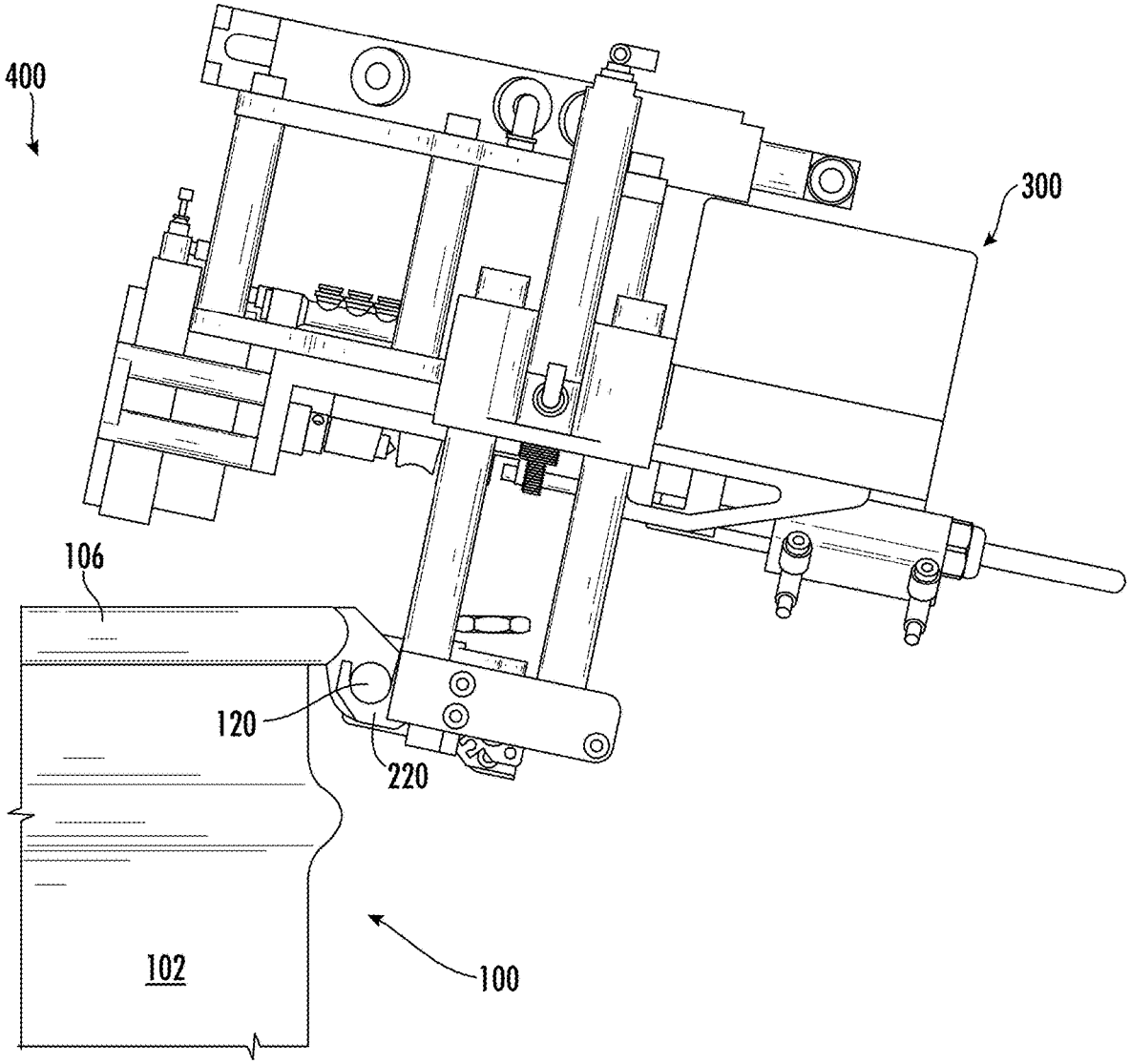
FIGS. 37-39 illustrate various views of the TID installation tool and the drum enclosure assembly shown in FIG. 36 during the installation process in accordance with aspects of the present subject matter.
Figure 38:
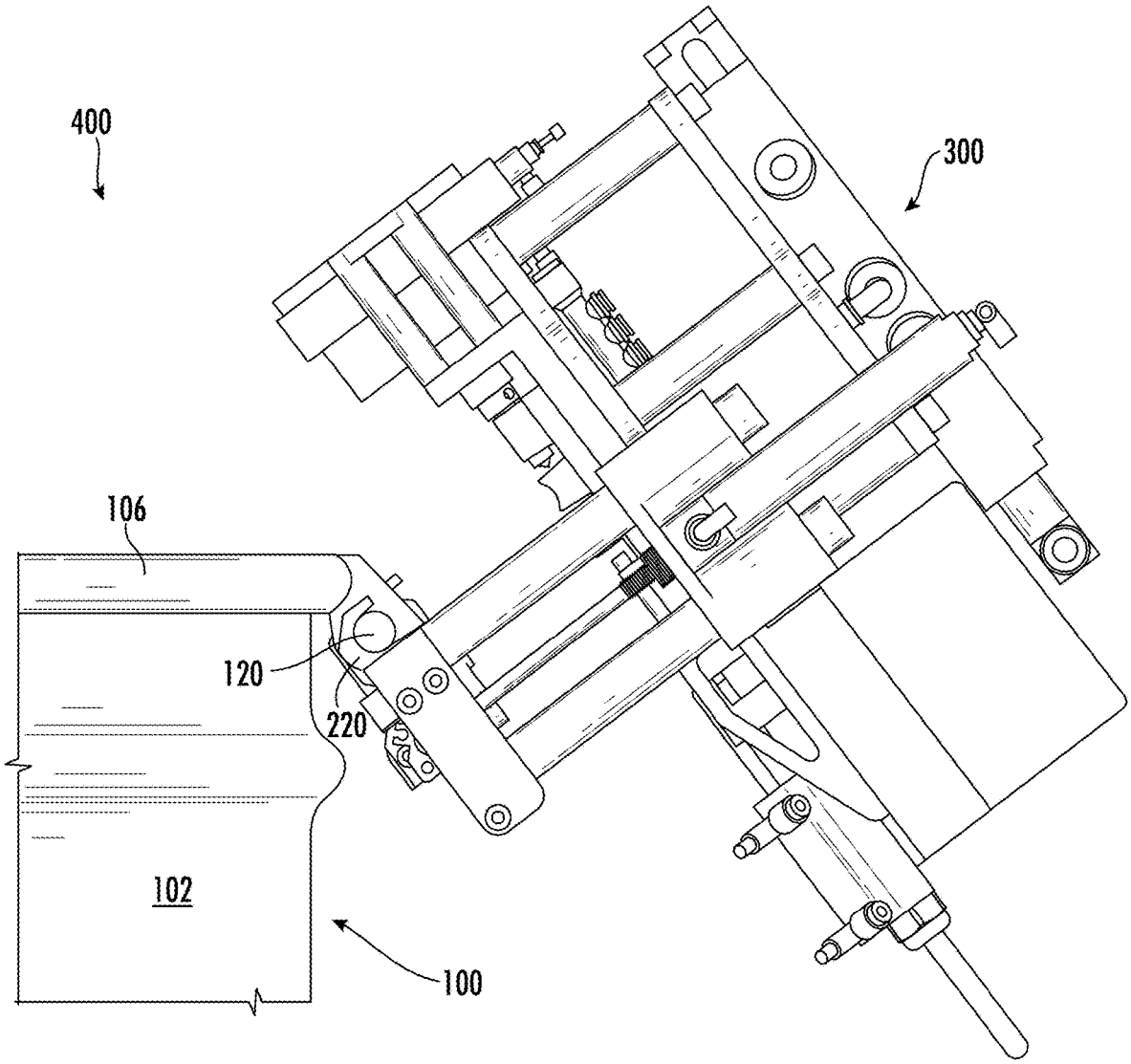
Figure 39:
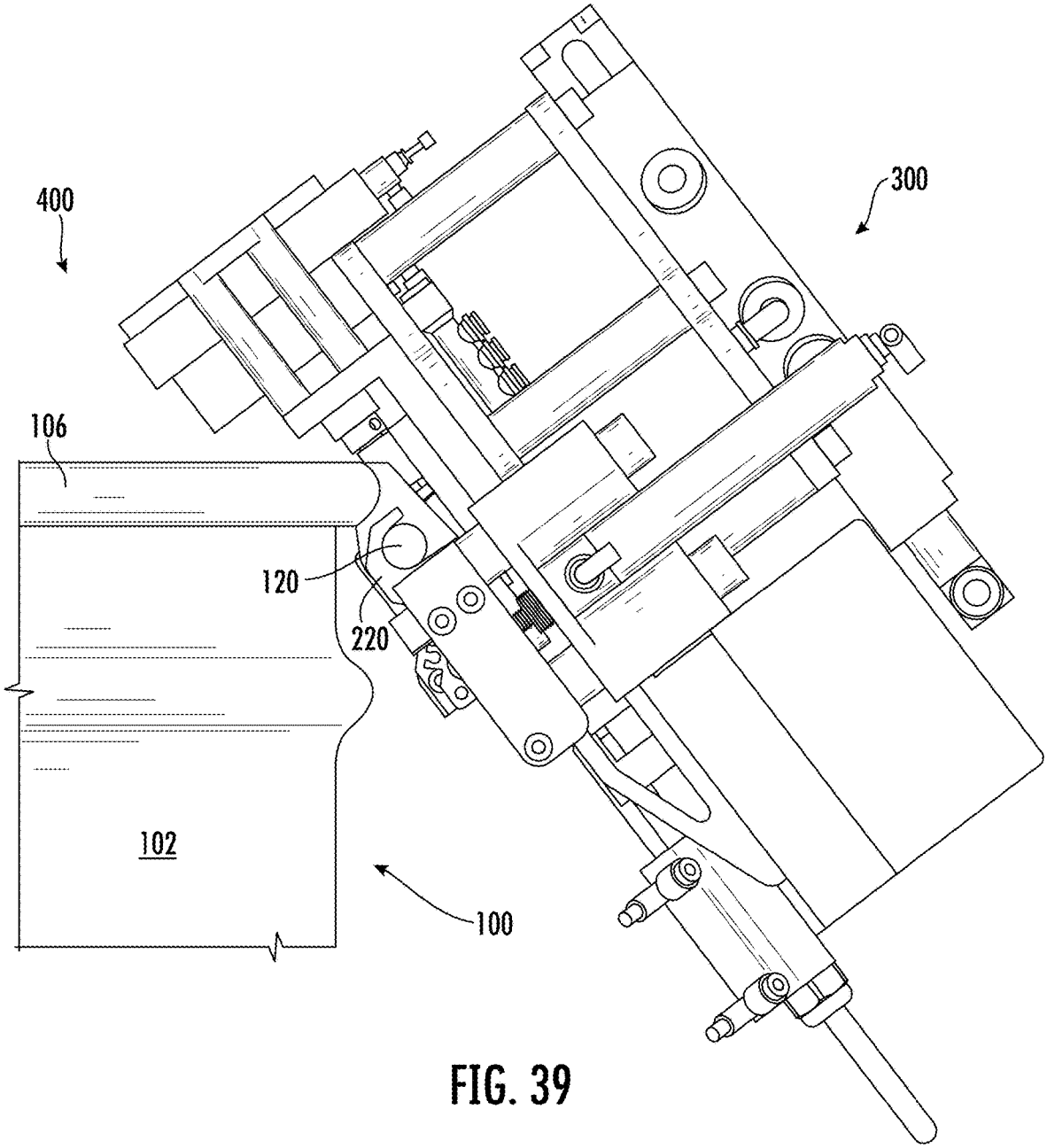

As shown in the transition from FIG. 37 to FIG. 38, once the TID 220 has been installed relative to the closure bolt 120 and flanged ends 108, 110, the robotic arm assembly 402 may be configured to reorient the installation tool 300 relative to the drum enclosure assembly 100 to the orientation shown in FIG. 38, thereby providing clearance for the pin deformation assembly 314 to be positioned relative to the opposed ends of the pin 250. Thereafter, as shown in the transition from FIG. 38 to FIG. 39, the actuators 320 of the first and second actuator assemblies 304, 306 of the tool 300 may be actuated to lower the pin deformation assembly 314 (and the remainder of the tool 300) relative to the TID support assembly 302 (and the tamper-indicating assembly 200 supported thereby). As described above, the first actuator 342 of the pin deformation assembly 314 is then used to press the pin 250 through the TID 220 (i.e., by pressing the pin 250 through the bore 238 of the TID 220 such that the head end 254 of the pin 250 is exposed along the exterior of the second side wall 242 of the mid body portion 224 of the TID 220). The second actuator 344 of the pin deformation assembly 314 is then used to deform the head end 254 of the pin 250 relative to the TID 220 (i.e., by flaring the annular lip 258 of the pin 250 radially outwardly relative to the second side wall 242 of the mid body portion 224 of the TID 220 using the punch assembly 345), thereby locking the pin 250 in place relative to the TID 220. In one embodiment, the installation tool 300 (and/or the robotic arm assembly 402 associated therewith) may then be used to capture an image of the serial number located on the pin 250 and store such image together with other data related to the drum enclosure assembly 100 within a data package. This information can then be subsequently verified when the tamper-indicating assembly 200 is ultimately removed when reopening the drum enclosure assembly 100.

It should be appreciated that, to allow the installation tool 300 to be properly maneuvered/positioned relative to the drum enclosure assembly 100, the robotic arm assembly 402 is generally required to perform complex maneuvers. In one embodiment, the robotic motion and associated pneumatic process may be hard-coded and a vision process (including associated cameras) may be used to precisely locate the bolt 120 of the drum enclosure assembly 100. The hard-coded robot motions may then be offset based on the position of the bolt 120 found via the vision process to ensure that the tool 300 is positioned/moved properly relative to the drum enclosure assembly 100 in a manner to permit the bolt 120 and flanged ends 108, 110 of the lid ring 106 to be received within the TID 220.

Additionally, it should be appreciated that various sensors may be utilized during the installation process. Sensors in the tool 300 (including in the pneumatic cylinders) prevent the robot from transitioning to the next phase in the process until each step has been verified; this verification enhances the reliability of the application without excessive additions to process time. In this regard, multiple sensors may be utilized throughout the process, including an inductive sensor to ensure the TID 220 is in the proper position before deformation and sensors embedded along the pneumatic cylinders to confirm the pin 250 is compressed properly. With this sensor feedback, physical verification is present throughout the application process.

Moreover, in several embodiments, methods of verification are measured to ensure the successful application of the tamper-indicating assembly 200 (e.g., due to security requirements). For example, once the tamper-indicating assembly 200 is applied with no negative sensor feedback, the robotic arm assembly 402 may be configured to change tools from the TID installation tool 300 to a laser profiler or scanner (e.g., a Keyence laser profiler). The scanner may be used to pass over the tamper-indicating assembly 200 to verify that the pin 250 is present and to collect/record the TID serial identification for the data package. Moreover, the laser may be used to scan the deformed end of the pin 250 to ensure a proper seal. By identifying the diameter of the depressed pin 250, automated software may be used to determine if the pin 250 was properly flared during installation. In one embodiment, this software program can function to recognize both whether the pin 250 was fully compressed using a predetermined diameter tolerance and if a section of the pin 250 did not flare out properly using a flaw detection algorithm on the circle. In one embodiment, to pass the verification process, the inspection must meet both metrics. This verification gives a benchmark reference for the manual inspection of the tamper-indicating assembly 200 upon the subsequent receipt of the drum enclosure assembly 100 within a secured facility.

Figure 40:
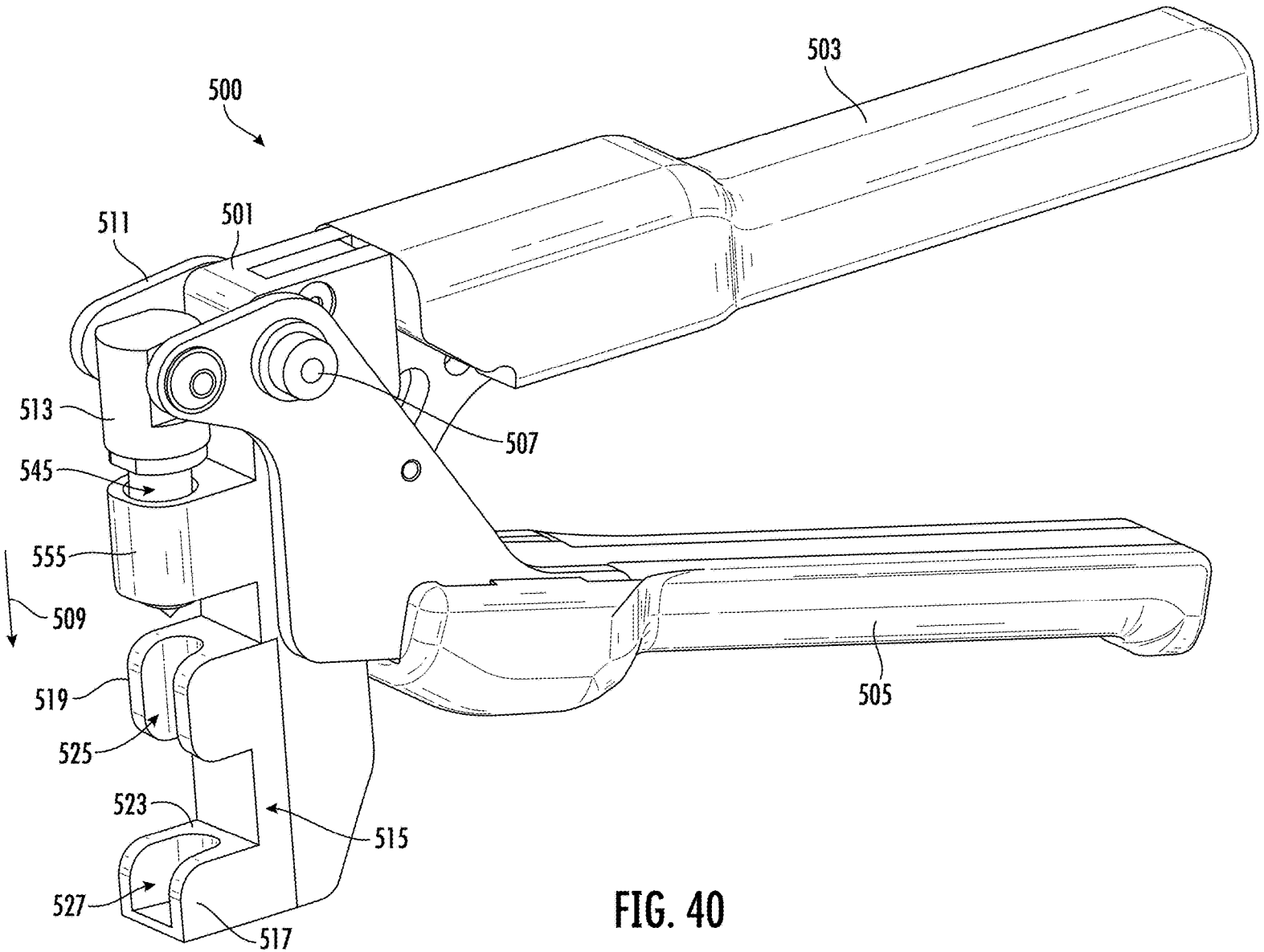
FIG. 40 illustrates a perspective view of one embodiment of a manual TID installation tool in accordance with aspects of the present subject matter.
Figure 41:
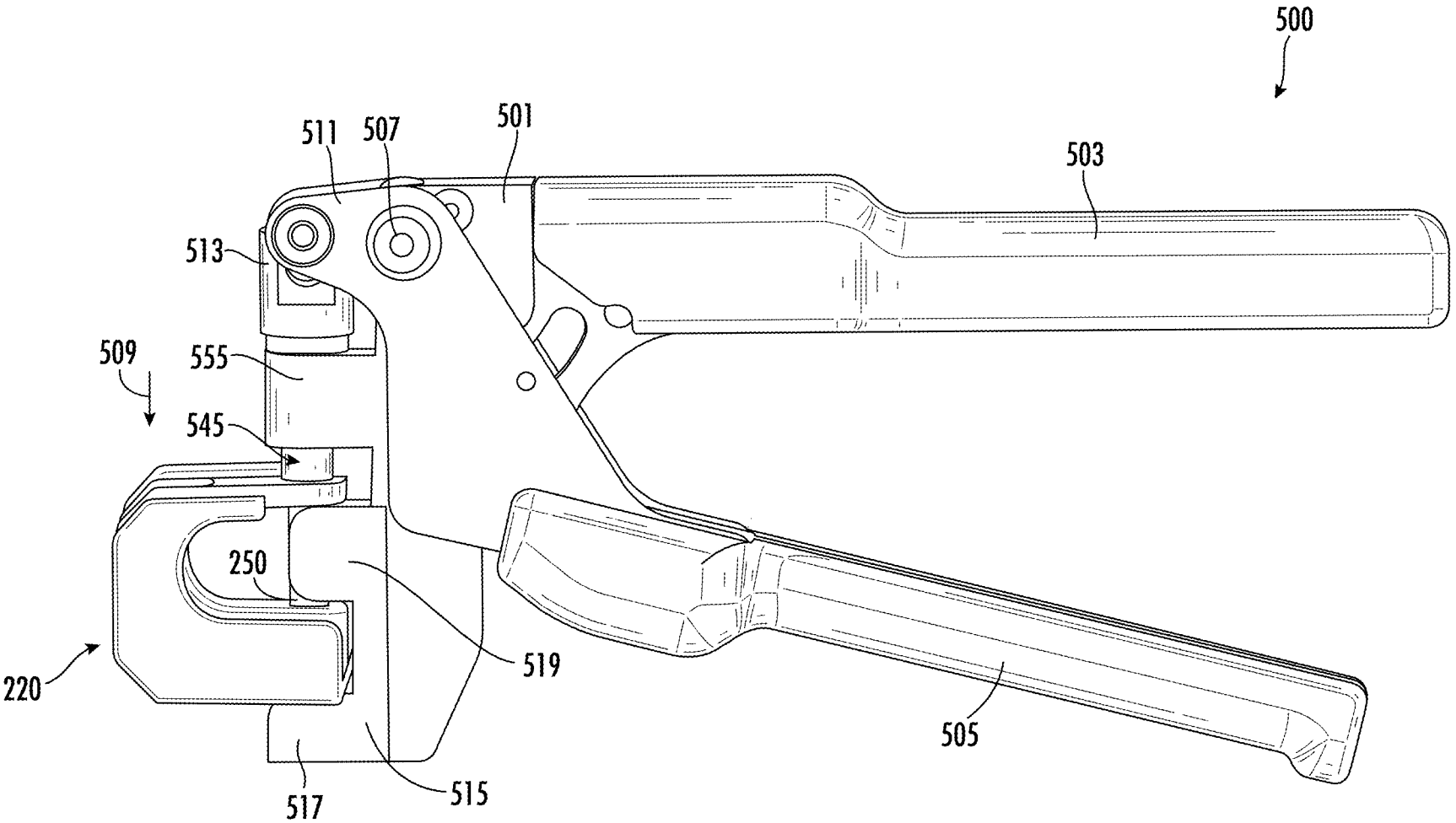
FIG. 41 illustrates a side view of the TID installation tool shown in FIG. 40 with a tamper-indicating assembly position relative to the tool in accordance with aspects of the present subject matter.
Figure 42:
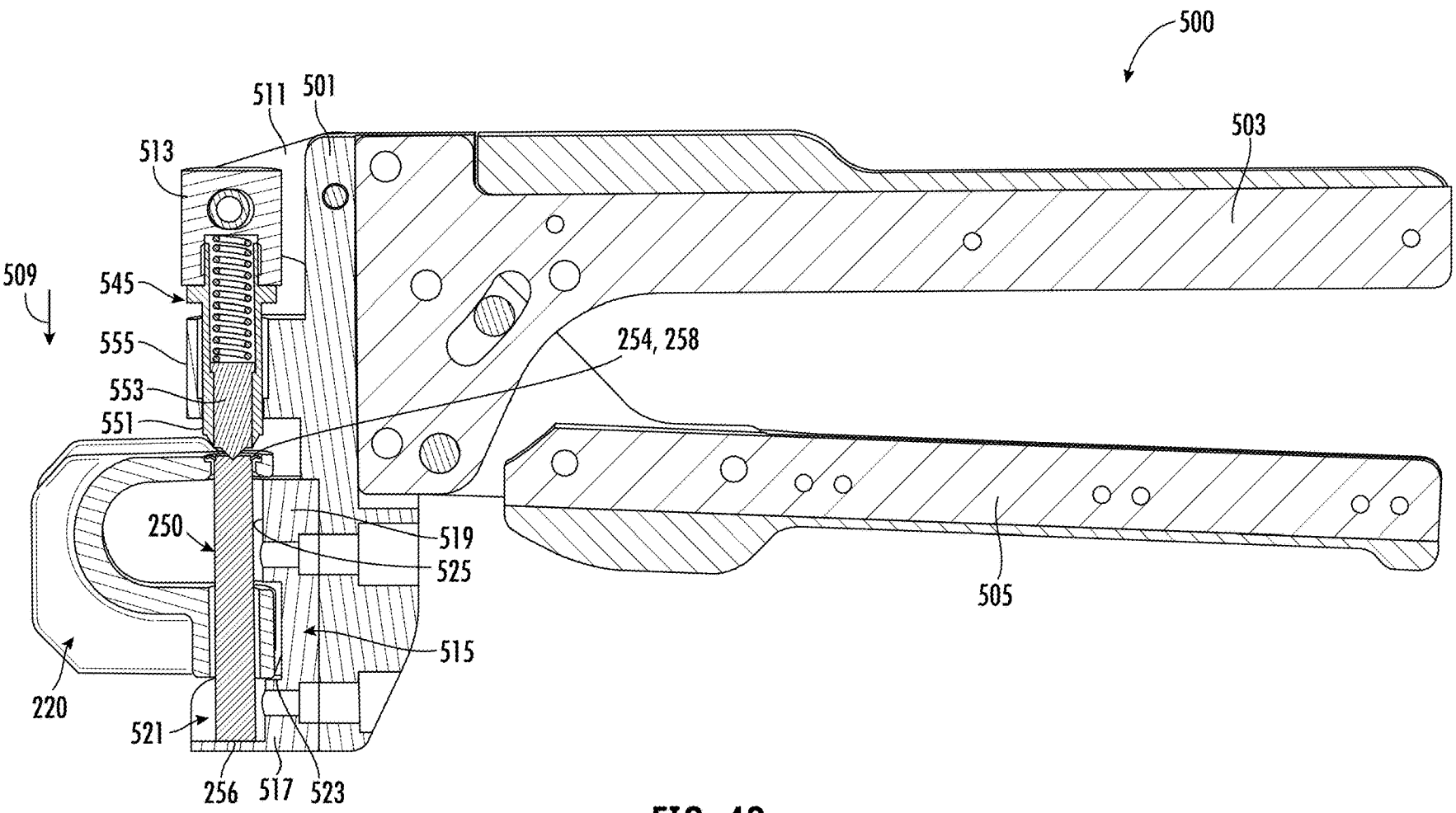
FIG. 42 illustrates a cross-sectional view of the TID installation tool and tamper-indicating assembly shown in FIG. 41.

Referring now to FIGS. 40-42, different views of one embodiment of a manual TID installation tool 500 are illustrated in accordance with aspects of the present subject matter. Specifically, FIG. 40 illustrates a perspective view of the manual tool 500 while FIG. 41 illustrates a side view of the tool 500 positioned relative to the tamper-indicating assembly 200 to allow the tool 500 to be used to deform the pin 250. Additionally, FIG. 42 illustrates a cross-sectional side view of the tool 500 and the tamper-indicating assembly 200 shown in FIG. 41, particularly illustrating details of a deformation punch assembly 545 of the manual tool 500.

As shown in FIGS. 40 and 41, the tool 500 includes a main tool body 501, first and second handles 503, 505 and a deformation punch assembly 545 coupled to the second handle 505. The first handle 503 is secured to the main body 501 (e.g., by being non-movably coupled to the body 501). The second handle 505 is pivotably coupled to the tool body 501 at a pivot joint 507 such that movement of the second handle 505 towards the first handle 503 (e.g., by squeezing the handles 503, 505 together) results in the punch assembly 545 being actuated in an actuation direction (indicated by arrow 509 in FIGS. 40-42).

In general, the punch assembly 545 may be configured the same as or similar as the punch assembly 345 described above with reference to the robotic installation tool 300. For instance, as shown in FIG. 42, the punch assembly 545 may generally include an outer deformation punch 551 coupled to the second handle 505 (e.g., via a lever portion 511 extending from the pivot joint 507 and a punch drive 513) and a spring-loaded locating pin 553 positioned or housed within the deformation punch 551. The 551 punch and locating pin 553 may generally be configured the same as or similar to the punch 351 and locating pin 353 described above. Thus, as the punch assembly 545 is being actuated in the actuation direction 509 towards the head end 254 of the pin 250, the locating pin 553 may initially be configured to be received within the locating notch 261 of the pin 250, thereby ensuring proper alignment of the punch assembly 545 with the pin 250. Thereafter, further actuation of the punch assembly 545 in the actuation direction 509 results in the annular lip 258 of the pin 250 being deformed outwardly to secure the pin 250 in place within the TID 220.

In addition, the tool 500 includes support structure for supporting the TID 220 and the pin 250 relative to the tool 500 during the deformation process. For instance, as particularly shown in FIGS. 40 and 41, the tool 500 may include a cradle 515 extending outwardly from the tool body 501 that includes first and second cradle portions 517, 519 configured to retain the TID/pin 220, 250 relative to the tool 500 during the deformation process. In several embodiments, the first cradle portion 517 may be configured to function as an endstop for the body end 256 of the pin 250 while also supporting the TID 220 relative to the tool 500. For instance, as shown in FIG. 40, the first cradle portion 519 defines a pin cavity 521 for receiving the body end 256 of the pin 250 and a support ledge 523 on top of which the TID 220 is configured to be supported. Moreover, the second cradle portion 519 may define a pin slot 525 configured to cradle or extend around a portion of the pin 250 extending between its opposed ends 254, 256. For instance, as shown in FIGS. 41 and 42, with the TID/pin 220, 250 positioned relative to the tool 500, the second cradle portion 519 may wrap around a portion the pin 250 and extend partially into the cavity 222 of the TID 220. As shown in the illustrated embodiment, the tool 500 may also include support structure for the punch assembly 545 as it is being actuated in the actuation direction 509 (e.g., as the handles 503, 505 are being squeezed together). For instance, as particularly shown in FIGS. 40-42, the tool 500 may include a punch guide 555 extending outwardly from the main body 501, with the punch guide 555 defining a through-hole for receiving the punch assembly 545. As such, during actuation of the tool 500, the punch assembly 545 may slide through the punch guide 555 to ensure that the punch assembly 545 is maintained in proper alignment with the pin 250.

To install the tamper-indicating assembly 200 using the tool 500, the tamper-indicating assembly 200 may be initially installed relative to the drum enclosure assembly 100, such as by manually positioning the TID 220 relative to the closure bolt 120 and flanged ends 108, 110 of the lid ring 106 and then inserting the pin 250 through the bore 238 of the TID 220. The tool 500 may then be positioned relative to the tamper-indicating assembly 200 such that the body end 256 of the pin 250 is received within the pin cavity 521 of the first cradle portion 517 and a separate portion of the pin 250 is received within the pin slot 525 of the second cradle portion 519. With the head end 254 of the pin 250 exposed along the outer side of the second side wall 242 of the TID 220, the punch assembly 545 may be actuated in the actuation direction 509 by squeezing the handles 503, 505 to deform the annular lip 258 of the pin 250 outwardly. In doing so, the first cradle portion 517 may function as an endstop to retain the body end 256 of the pin 250 in place as the punch assembly 545 is being actuated into the head end 254 of the pin 250 to deform the lip 258.

This written description uses examples to disclose the technology, including the best mode, and also to enable any person skilled in the art to practice the technology, including making and using any devices or systems and performing any incorporated methods. The patentable scope of the technology is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal language of the claims.

What is claimed is:

1. A system for installing tamper-indicating assemblies relative to drum enclosure assemblies, the system comprising:

a drum enclosure assembly including a lid ring extending from a first flanged end to a second flanged end, the drum enclosure assembly further including a closure bolt extending through the first and second flanged ends;

a tamper-indicating device (TID) defining a cavity configured to receive at least a portion of the closure bolt and the first and second flanged ends of the lid ring, the TID defining a bore relative to the cavity;

a pin configured to extend through the bore of the TID and across the cavity of the TID, the pin including a pin body extending from a body end to a head end, the head end including an annular lip defining a cavity at the head end of the pin;

an installation tool for installing and securing the pin relative to the TID, the installation tool comprising:

a support assembly configured to support the TID;

a pin deformation assembly having first and second pin actuators, the first pin actuator being configured to push the pin through the bore of the TID, the second pin actuator being configured to deform the annular lip of the head end of the pin radially outwardly relative to an adjacent portion of the TID.

2. The system of claim 1, wherein the TID includes a first side wall and a second side wall and wherein the bore includes a first bore portion defined through the first side wall and a second bore portion defined through the second side wall, the pin being configured to extend through the first bore portion across the cavity and into the second bore portion.

3. The system of claim 2, wherein the first pin actuator is configured to be actuated such that a push rod of the first pin actuator contacts the body end of the pin and pushes the pin through the first bore portion across the cavity and into the second bore portion in an installation direction.

4. The system of claim 3, wherein the pin deformation assembly further comprises a locking actuator configured to lock the push rod in place relative to the TID to prevent movement of the pin in a removal direction opposite the installation direction while the second pin actuator is being actuated to deform the head end of the pin.

5. The system of claim 2, wherein the second bore portion of the bore is sized such that the head end of the pin body is configured to be received within the second bore portion but at least a portion of the pin body extending from the head end is not configured to be received within the second bore portion, the first pin actuator being configured to push the pin through the bore until the at least a portion of the body contacts against an inner side of the second side wall and the head end of the pin is exposed along an opposed, outer side of the second side wall.

6. The system of claim 5, wherein the second pin actuator is configured to deform the head end of the pin such that a deformed portion of the head end is configured to engage at least a portion of the outer side of the second side wall.

7. The system of claim 1, wherein the second pin actuator comprises a deformation punch configured to be actuated relative to the head end of the pin to deform the annular lip radially outwardly relative to the adjacent portion of the TID.

8. The system of claim 7, wherein the second pin actuator comprises a spring-loaded locating pin housed within the deformation punch, the locating pin configured to be received within the cavity as the deformation punch is being actuated relative to the head end of the pin.

9. The system of claim 8, wherein the pin defines a locating notch within a portion of the cavity, the locating pin configured to be received within the locating notch as the deformation punch is being actuated relative to the head end of the pin.

10. The system of claim 1, wherein the support assembly comprises first and second clamping blocks movable between an unlocked position, at which the first and second clamping blocks are spaced apart from the TID, and a locked position, at which the first and second clamping blocks are engaged against the TID.

11. The system of claim 10, wherein, at the locked position, the first and second clamping blocks are further configured to engage at least a portion of the pin.

12. The system of claim 1, further comprising a robotic arm coupled to the installation tool and being configured to position the installation tool relative to the drum enclosure assembly.

13. A system for installing tamper-indicating assemblies relative to drum enclosure assemblies, the system comprising:

a drum enclosure assembly including a lid ring extending from a first flanged end to a second flanged end, the drum enclosure assembly further including a closure bolt extending through the first and second flanged ends;

a tamper-indicating device (TID) defining a cavity configured to receive at least a portion of the closure bolt and the first and second flanged ends of the lid ring, the TID defining a bore relative to the cavity;

a pin configured to extend through the bore of the TID and across the cavity of the TID, the pin including a pin body extending from a body end to a head end;

an installation tool for installing and securing the pin relative to the TID, the installation tool comprising:

a support assembly configured to support the TID, wherein the support assembly comprises first and second clamping blocks movable between an unlocked position, at which the first and second clamping blocks are spaced apart from the TID, and a locked position, at which the first and second clamping blocks are engaged against the TID;

a pin deformation assembly having first and second pin actuators, the first pin actuator being configured to push the pin through the bore of the TID, the second pin actuator being configured to deform the head end of the pin relative to the TID.

14. The system of claim 13, wherein, at the locked position, the first and second clamping blocks are further configured to engage at least a portion of the pin.

15. The system of claim 13, wherein the TID includes a first side wall and a second side wall and wherein the bore includes a first bore portion defined through the first side wall and a second bore portion defined through the second side wall, the pin being configured to extend through the first bore portion across the cavity and into the second bore portion.

16. The system of claim 15, wherein the second bore portion of the bore is sized such that the head end of the pin body is configured to be received within the second bore portion but at least a portion of the pin body extending from the head end is not configured to be received within the second bore portion, the first pin actuator being configured to push the pin through the bore until the at least a portion of the body contacts against an inner side of the second side wall and the head end of the pin is exposed along an opposed, outer side of the second side wall.

17. The system of claim 16, wherein the second pin actuator is configured to deform the head end of the pin such that a deformed portion of the head end is configured to engage at least a portion of the outer side of the second side wall.

18. A system for installing tamper-indicating assemblies relative to drum enclosure assemblies, the system comprising:

a drum enclosure assembly including a lid ring extending from a first flanged end to a second flanged end, the drum enclosure assembly further including a closure bolt extending through the first and second flanged ends;

a tamper-indicating device (TID) defining a cavity configured to receive at least a portion of the closure bolt and the first and second flanged ends of the lid ring, the TID defining a bore relative to the cavity, wherein the TID includes a first side wall and a second side wall and wherein the bore includes a first bore portion defined through the first side wall and a second bore portion defined through the second side wall;

a pin configured to extend through the first bore portion of the TID across the cavity and into the second bore portion of the TID, the pin including a pin body extending from a body end to a head end;

an installation tool for installing and securing the pin relative to the TID, the installation tool comprising:

a support assembly configured to support the TID;

a pin deformation assembly having first and second pin actuators and a locking actuator, the first pin actuator being configured to be actuated such that a push rod of the first pin actuator contacts the body end of the pin and pushes the pin through the first bore portion of the TID across the cavity and into the second bore portion of the TID in an installation direction, the second pin actuator being configured to deform the head end of the pin relative to the TID, the locking actuator configured to lock the push rod in place relative to the TID to prevent movement of the pin in a removal direction opposite the installation direction while the second pin actuator is being actuated to deform the head end of the pin.

19. The system of claim 18, wherein the second bore portion of the bore is sized such that the head end of the pin body is configured to be received within the second bore portion but at least a portion of the pin body extending from the head end is not configured to be received within the second bore portion, the first pin actuator being configured to push the pin through the bore until the at least a portion of the body contacts against an inner side of the second side wall and the head end of the pin is exposed along an opposed, outer side of the second side wall.

20. The system of claim 19, wherein the second pin actuator is configured to deform the head end of the pin such that a deformed portion of the head end is configured to engage at least a portion of the outer side of the second side wall.

* * * * *